US007111961B2

(12) United States Patent
Trenchard et al.

(10) Patent No.: US 7,111,961 B2
(45) **Date of Patent: *Sep. 26, 2006**

(54) HIGH FLUX LED LIGHTING DEVICE

(75) Inventors: Stephen E. Trenchard, Kingwood, TX (US); Alan Trojanowski, Dayton, TX (US)

(73) Assignee: Automatic Power, Inc., Houston, TX (US)

( * ) Notice: Subject to any disclaimer, the term of this patent is extended or adjusted under 35 U.S.C. 154(b) by 223 days.

This patent is subject to a terminal disclaimer.

(21) Appl. No.: 10/695,191

(22) Filed: Oct. 28, 2003

(65) Prior Publication Data

US 2004/0095777 A1 May 20, 2004

Related U.S. Application Data

(60) Provisional application No. 60/427,438, filed on Nov. 19, 2002.

(51) Int. Cl.
*F21V 1/00* (2006.01)
*F21V 11/00* (2006.01)

(52) U.S. Cl. ..... 362/235; 362/249; 362/294; 362/311; 362/331; 362/477; 362/540; 362/545

(58) Field of Classification Search ..... 362/235, 362/249, 294, 311, 477, 540, 331, 545
See application file for complete search history.

(56) References Cited

U.S. PATENT DOCUMENTS 1,764,622 A 6/1930 Goodwin
3,221,162 A * 11/1965 Heenan et al. ..... 362/477
4,360,862 A 11/1982 Strasser et al.
4,463,399 A 7/1984 Matherly et al.
5,140,220 A 8/1992 Hasegawa
5,224,773 A 7/1993 Arimura
5,237,490 A * 8/1993 Ferng ..... 362/183
5,585,783 A 12/1996 Hall
5,608,290 A 3/1997 Hutchisson et al.
5,664,866 A 9/1997 Reniger et al.
5,769,532 A 6/1998 Sasaki
5,821,695 A 10/1998 Vilanilam et al.
5,833,355 A 11/1998 You et al.
5,857,767 A 1/1999 Hochstein
5,890,794 A * 4/1999 Abtahi et al. ..... 362/294
5,899,557 A 5/1999 McDermott
5,929,788 A * 7/1999 Vukosic ..... 340/908.1
5,931,570 A 8/1999 Yamuro
5,947,588 A 9/1999 Huang
6,013,985 A 1/2000 Green et al.
6,048,083 A 4/2000 McDermott
6,086,220 A * 7/2000 Lash et al. ..... 362/244
6,135,612 A 10/2000 Clore (Continued)

OTHER PUBLICATIONS

A19 Style 3D PedLED Solid-State Light Bulb, Ledtronics, Inc., Jun. 24, 2002.
Dialight 860 Series LED Obstruction Light, Dialight Coproration, Farmingdale, NJ, date unknown.

(Continued)

*Primary Examiner*—Thomas M. Sember
*Assistant Examiner*—Jason Moon Han
(74) *Attorney, Agent, or Firm*—Elizabeth R. Hall

(57) ABSTRACT

A lighting device having a plurality of high flux LEDs mounted on a heat sink and surrounded by a diffuser. The heat sink serves to transfer heat from the LEDs to the outside environment. In one embodiment the lighting device is positioned within a fresnel lens to produce a distribution of light.

23 Claims, 17 Drawing Sheets

U.S. PATENT DOCUMENTS

| | | | | |
|---|---|---|---|---|
| 6,183,100 | B1 * | 2/2001 | Suckow et al. | 362/35 |
| 6,425,678 | B1 * | 7/2002 | Verdes et al. | 362/244 |
| 6,626,557 | B1 * | 9/2003 | Taylor | 362/249 |
| 2001/0030866 | A1 | 10/2001 | Hochstein | |
| 2002/0114170 | A1 | 8/2002 | Chen et al. | |

OTHER PUBLICATIONS

LED Obstruction Light Lasis Longer for Less Maintenance, Dialight Corporation, Farmingdale, N.J., Nov. 29, 2001.
Dialight Corporation Offers First LED-based Flashing Red Beacon, Dialight Corporation, Farmingdale, N.J., Jun. 25, 2001.

* cited by examiner

HIGH FLUX LED LIGHTING DEVICE

CROSS REFERENCE TO RELATED APPLICATIONS

This application claims priority to pending U.S. Patent Application Ser. No. 60/427,438, filed Nov. 19, 2002 by inventors Steve Trenchard and Alan Trojanowski and entitled "Omni-Directional LED Marine Safety Light."

BACKGROUND OF THE INVENTION

1. Field of the Invention

The present invention relates generally to a lighting device having high flux light emitting diodes, or LEDs, mounted on a heat sink and surrounded by a diffuser. The present invention further relates to a LED assembly having a plurality of LEDs mounted on a heat sink and surrounded by a diffuser, wherein the LED assembly is positioned within a fresnel lens.

2. Description of the Related Art

Reliable safety lights are critical for the safety of boats to prevent accidental collisions during darkness and inclement weather. The vast majority of marine safety lights, such as the one disclosed in U.S. Pat. No. 5,711,591 issued to Jordan use incandescent light bulbs as the light source.

A number of attempts have been made to replace marine filament bulbs with LEDs in marine safety lights because of their relatively small power consumption and long life. Incandescent bulbs have a resistant tungsten filament suspended by support wires with a vacuum inside a glass bulb. As a result, they are highly susceptible to damage due to temperature variations and vibrations. The typical life of incandescent bulbs usually averages one or two thousand hours, so that they must be replaced several times a year.

LEDs, on the other hand, are more efficient than bulbs at converting electricity into light. LEDs are also durable and immune to filament breakage due to shock or vibration. Therefore, LEDs have a life span of approximately 50,000 hours versus one to two thousand hours for an incandescent bulb. This means that the bulbs do not have to be replaced nearly so often and do not require much maintenance. This is particularly important for marine lanterns that are difficult to get to.

However, LEDs are not without their problems. Several of these problems are discussed in a paper entitled *Design Considerations for Reliability and Optical Performance of LED Signal Lights* given by Paul F. Mueller at the XVth IALA Conference, March 2002. A first problem is that typical low output 5 millimeter LEDs, having a driving current ranging from about 50 to 70 milliwatts, put out very little light. Although it is possible to increase the optical output considerably by increasing the forward current above the nominal rated value, such an increase in forward current generally leads to premature failure due to overheating of the diode junction. A second problem is that LEDs have a poorly directed, non-uniform and excessively divergent pencil beam pattern. It is customary to produce a 360° beam pattern of superimposed pencil beams by arraying multiple LED sources in a circular, outward-directed pattern. While this provides an omni-directional beam pattern, lacking further optical enhancement, the result is energy inefficient and grossly non-uniform in horizon intensity.

There are several major manufacturers that produce marine lanterns with LEDs including: Carmanah Technologies, Inc., Zeni Buoy Light Company Limited, Vega Industries Limited, Tideland Signal Corporation, and Sabik Oy.

All of the currently available marine lanterns using LEDs use low output LEDs. Thus, all of these lanterns require large numbers of, up to several hundred, LEDs to produce the minimal total flux (lumens or candlepower) necessary for a marine lantern.

Marine LED lanterns use multiple arrays of numerous LEDs that do not have a single point source of light and cannot use a fresnel lens to capture and focus the light from the LED arrays used. All five of the manufacturers mentioned above have been required to design new lenses to capture and focus the light from their LED arrays.

One approach to this problem has been to design a fine lens incorporated in front of the LEDs to converge the beam of light and increase the luminance thereof. For example, U.S. Pat. No. 5,224,773 discloses a thin fresnel lens made by rolling and welding the edges of a thin, transparent film of acrylic resin with a fine-pitched surface that is formed by heating and pressing a mold for a thin linear fresnel lens to form a cylinder. Alternatively, U.S. Pat. No. 6,048,083 issued to McDermott describes an optic lens that is contoured to create a plurality of focal points which form a bent or crooked focal line cooperate with the orientation of the LED elements to project a composite light beam with limited divergence about a first reference plane.

Another approach has been to construct a small marine safety light that has a much lower candlepower. U.S. Pat. No. 6,086,220 issued to Lash et al. describes a marine safety light having six or more low output LEDs having a uniform star configuration. The inventors determined that such an LED array produced visible light over one nautical mile away from the vessel, whereas most marine lanterns must meet a 60 candela requirement for a three to four mile visibility.

There is an existing need for a marine lantern that replaces the incandescent bulb with LEDs that has sufficient candlepower and provides an omni-directional beam pattern.

SUMMARY OF THE INVENTION

A lighting device is described having 12 or less high flux LEDs mounted on a heat sink within a fresnel lens. The heat sink serves to transfer heat from the LEDs to the outside environment. The safety light further includes a diffuser located between the LEDs and the fresnel lens.

One aspect of the present invention is a lighting device comprising: (a) a plurality of LEDs disposed in a radial array about a vertical axis; (b) a central member having each LED mounted on a vertical surface thereof, the central member made of a thermally conductive material to conduct heat away from the LEDs; and (c) a hollow member having a dentated surface, wherein the dentated surface surrounds the LEDs to diffuse the light emitted from the LEDs.

Another aspect of the present invention is a lighting device comprising: (a) a lighting assembly having (i) a heat sink having at least one centralized right angle prism with a square horizontal cross-section with a plurality of vertical surfaces, (ii) a plurality of equispaced LEDs, each LED mounted on a vertical surface of the heat sink, and (iii) a tubular diffuser having a frosted surface, wherein the frosted surface surrounds the LEDs to diffuse the light emitted from the LEDs; and (b) a fresnel lens surrounding the lighting assembly; whereby light emanating from the LEDs passes through the diffuser and the fresnel lens to provide a substantially uniform horizontal plane of light.

Yet another aspect of the present invention is a lighting assembly comprising: (a) a plurality of equispaced high flux LEDs; (b) a controller for conditioning electric power for the LEDs; (c) a heat sink for transferring heat from the LEDs, wherein each LED is secured to the heat sink; and (d) a tubular diffuser surrounding the LEDs having a roughened surface with a random pattern of microfaceted angles on the surface, wherein the microfaceted angles diffuse the light emitted from the LEDs.

The foregoing has outlined rather broadly several aspects of the present invention in order that the detailed description of the invention that follows may be better understood and thus is not intended to narrow or limit in any manner the appended claims which define the invention. Additional features and advantages of the invention will be described hereinafter which form the subject of the claims of the invention. It should be appreciated by those skilled in the art that the conception and the specific embodiment disclosed may be readily utilized as a basis for modifying or designing of the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

One embodiment of the present invention relates to a lighting device using high flux light emitting diodes, or LEDs, mounted on a heat sink in a conventional fresnel lens having a diffuser positioned between the LEDs and the fresnel lens.

Figure 1:
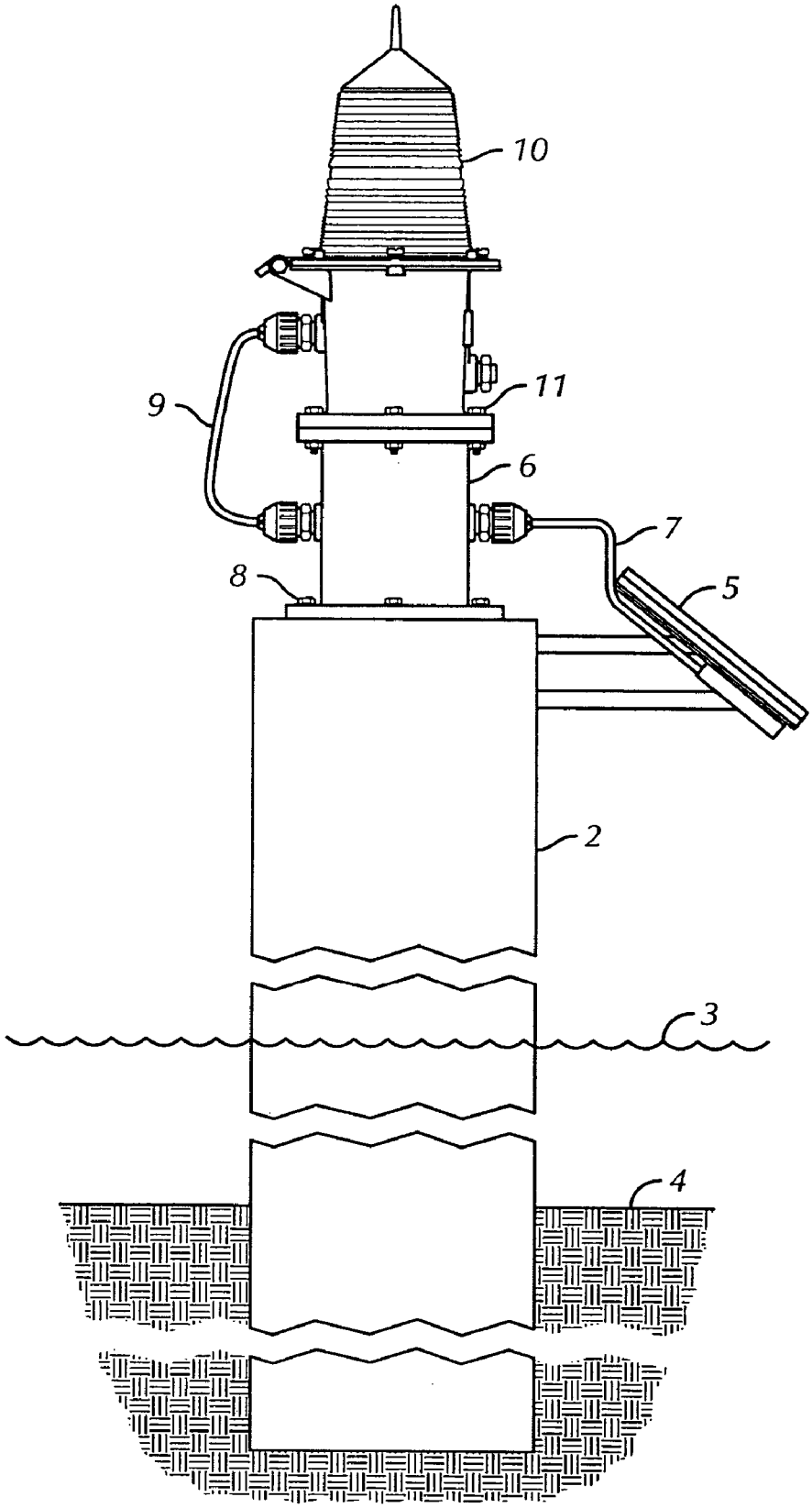
FIG. 1 is a plan view in partial section of a typical installation of a lighting device of the present invention in a lighting device mounted on a marine piling.

Referring now to the drawings and initially to FIG. 1, it is pointed out that like reference characters designate like or similar parts throughout the drawings. The Figures, or drawings, are not intended to be to scale. For example, purely for the sake of greater clarity in the drawings, wall thickness and spacing are not dimensioned, as they actually exist in the assembled embodiment.

The typical low output LEDs currently available in lighting devices, such as those used for marine and airport safety lights, do not put out sufficient lumens or candlepower to meet the required three to four mile visibility. The low output LEDs are 5 mM in size and have a driving current of about 50 to 70 milliwatts. Recently, high output LEDs (1 Watt and 5 Watt LEDs) have become available. The current invention solves the problem of insufficient lumens by using a dozen or less high flux LEDs, rather than the traditional low flux LEDs. However, the high flux LEDs have their own set of attendant problems. High flux LEDs being defined herein as LEDs with a driving current of about 1–5 Watts and having a high output of lumens.

One problem with using the high flux LEDs is that they produce substantial heat compared to the lower power LEDs used in earlier beacon devices and marine and airport safety devices. The resultant heat buildup within the safety light can lead to a precipitous reduction in service life for the LEDs. Thus, the present invention provides for a heat sink to transfer heat away from the LEDs. The aluminum structures upon which the LEDs of the present invention are mounted function as heat sinks so that much of the heat is transferred by conduction to regions in the safety light that are remote from the LEDs and then transferred to the environment by convection and radiation.

Another problem, which arises with the use of a minimal number of high flux LEDs instead of the very large numbers of lower power LEDs of prior designs, is the lack of broad, relatively uniform angular dispersion from the LEDs. This lack of uniform dispersion has been remedied in the present invention by means of providing an optical diffuser to redistribute the emitted light from the LEDs in a more uniform manner in spherical coordinates. This feature of the present invention, in combination with the other aforementioned features, provides the characteristics necessary for enabling a compact LED retrofit lighting device to replace the population of existing traffic and designed for incandescent bulb sources.

Figure 2:
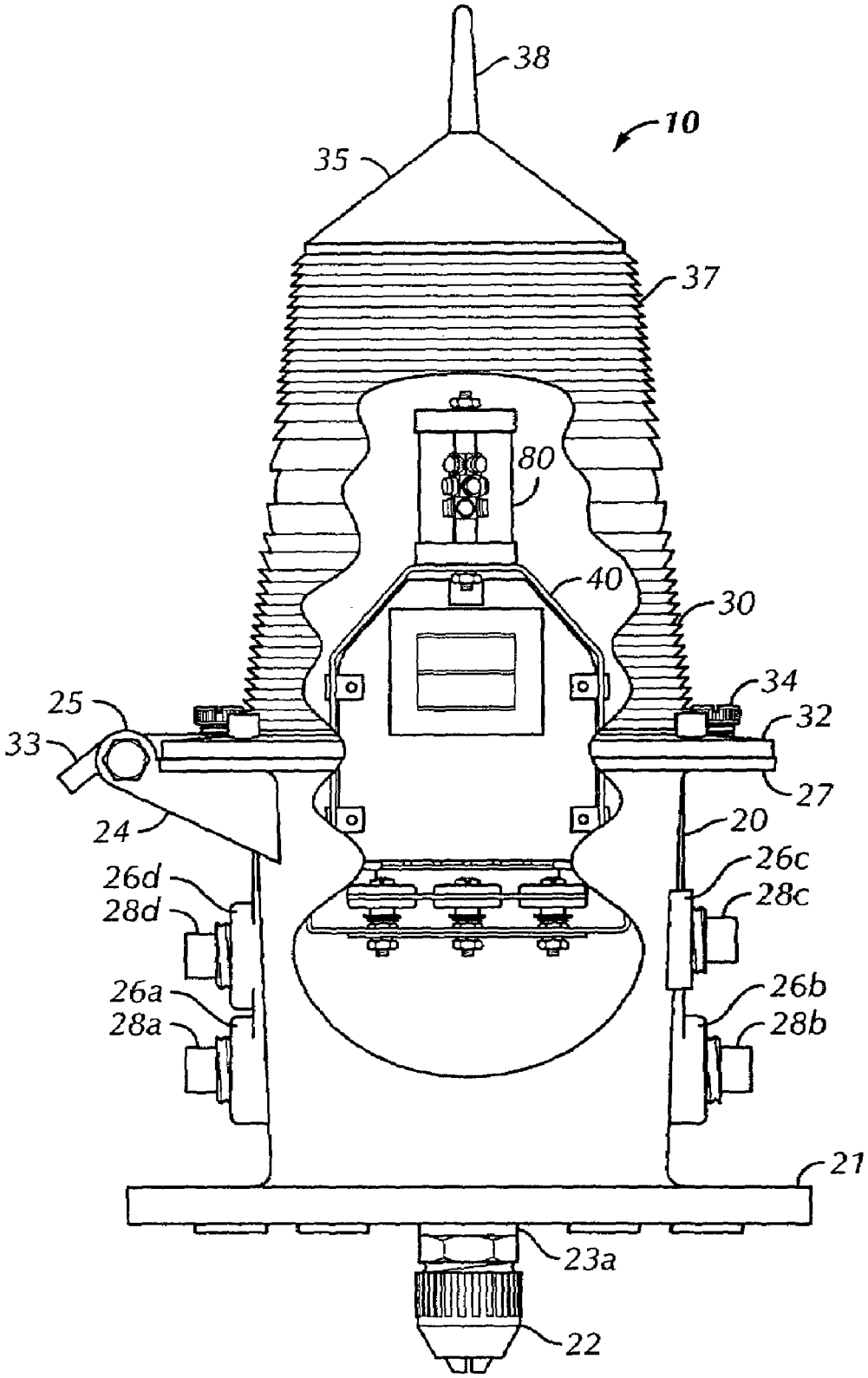
FIG. 2 is a profile view, partially in section, showing the source LED module of the lighting device and its mounting base.

Several embodiments of the lighting device of the present invention are described in detail below. One embodiment of the lighting device 10 of the present invention, shown in FIGS. 1 and 2, is often installed on bridges, offshore platforms, airport towers, marine beacons, and the like. FIG. 1 illustrates an example of lighting device 10 installed on a marine beacon. This type of installation is commonly used on remote channel markers for navigable waterways. A piling 2 of either treated wood, concrete or pipe is driven into the soil below the mudline 4 to support the lighting device 10 high enough above the water surface 3 to prevent the lighting device 10 from being damaged by wakes, waves, and the like.

The lighting device 10 is optionally powered by batteries contained in the tubular battery case 6 that has a closed bottom flange, an annular top flange, and is mounted on the top of piling 2. The batteries in the interior of case 6 are recharged by electricity generated by the solar panel assembly 5 and transferred to the batteries by means of solar collector cable 7. Cable 7 penetrates into the side of case 6 through a sealing fitting. The solar panel assembly 5 is mounted on the top of the piling 2 or, alternatively, on battery case 6. The battery case 6 is attached to the top of pile 2 by means of mounting bolts 8.

Power cable 9 emerges from a sealing fitting in the side of case 6 and supplies electricity from the battery case 6 to lighting device 10. Cable 9 here is shown entering the side of the mounting base of lighting device 10 through a sealing fitting. Lighting device 10 is mounted to the top of battery case 6 by means of base attachment bolts 11. Without departing from the spirit of the invention, the electrical power could also be supplied from a remote external source by means of a supply cable and the battery case 6 and/or the solar panel assembly 5 omitted.

Unless noted as being made of specific materials, the lighting device of the present invention can be made of a variety of materials. However, the preferred construction materials are steel or aluminum alloy for structural items and insulated copper wire for wiring connections.

Figure 3:
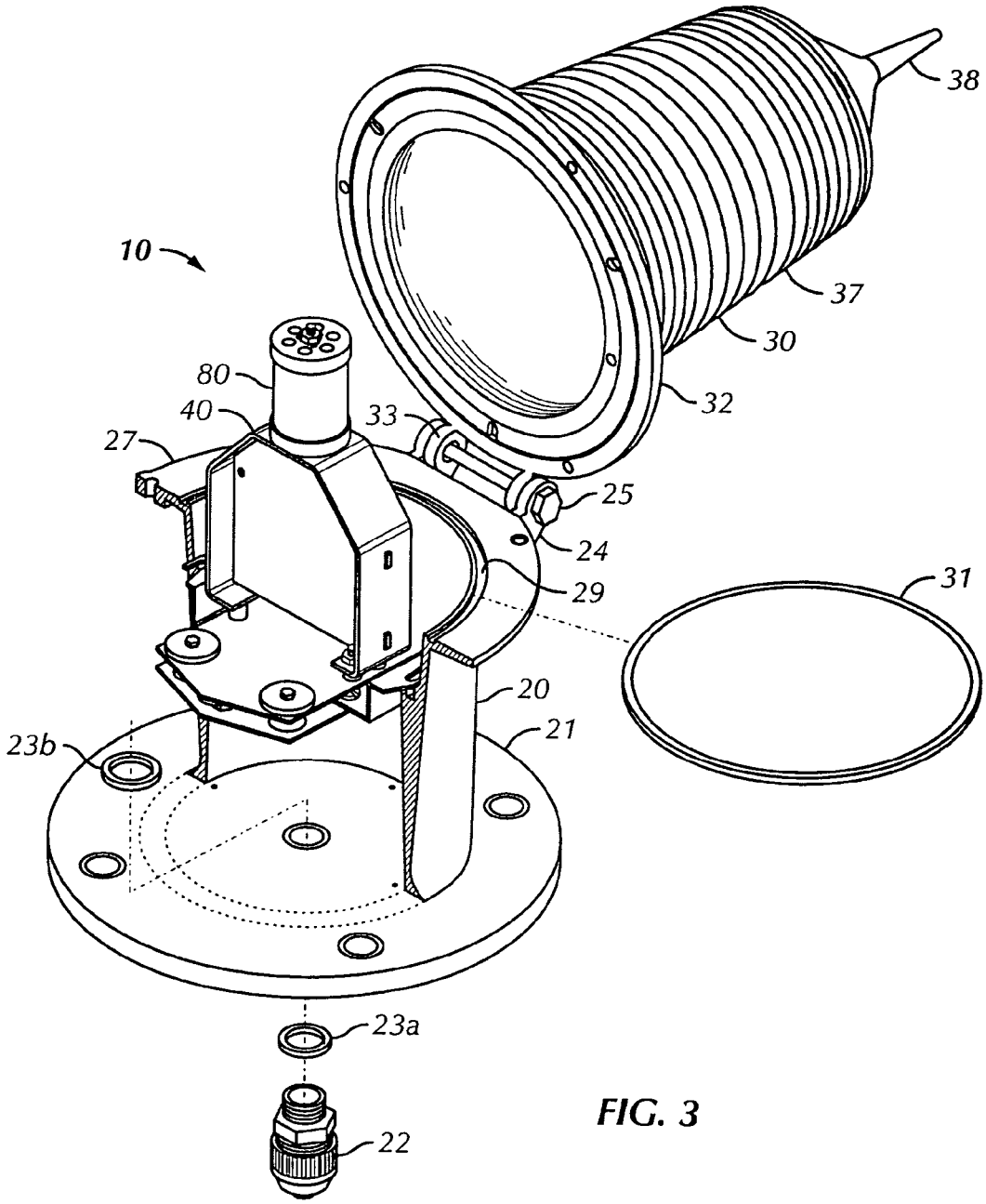
FIG. 3 is a partially exploded oblique view, partially in section, showing one embodiment of the mounting of the control unit and the light source in the mounting base.

FIGS. 2 and 3 show general details of the lighting device 10 and specifically the interrelationship of its mounting base 20, the lantern lens assembly 30, and the light-emitting diode (LED) source assembly 80 which is the source of the light from the lighting device. The mounting base 20 is a tubular substantially right circular cylinder with right circular cylindrical lower transverse blind mounting flange 21 and transverse annular top flange 27. The mounting base is typically a painted aluminum casting, so that its approximately cylindrical wall surfaces are slightly conical in order to provide draft for the extraction of the casting patterns. A bolt circle of holes in mounting flange 21 accommodate bolts 11 so that mounting base 20 can be bolted to corresponding tapped holes in battery case 6.

Mounting flange 21 has an axial tapped hole, which mounts commercially available sealing cable fitting 22 so that the power cable 9 (not shown) can enter the lighting device 10. Annular gasketed sealing washers 23*a,b* respectively seal the exterior and the interior of the joint between fitting 22 and flange 21. In the arrangement shown in FIG. 2, fitting 22 extends downwardly into the battery case 6, but serves to isolate the interior of mounting base 20 from the potentially corrosive conditions of the battery case.

Mirror image hinge brackets 24, extending outwardly from the exterior of mounting base 20 adjacent to top flange 27, are symmetrically offset from a vertical plane through the axis of the mounting base and have coaxial hinge holes normal to the vertical plane. The axis of the hinge holes in hinge brackets 24 is approximately at the level of the upper surface of top flange 27. Hinge pin 25 consists of a bolt and nut and is mounted in the hinge holes of hinge brackets 24.

External threaded bosses 26*a,b,c,d* on the approximately cylindrical outer wall of mounting base 20 are drilled and tapped for alternative cable entry locations, which are shown sealed with threaded plugs 28*a,b,c,d*, but which could likewise be used, to mount fitting 22.

The upper transverse face of top flange 27 has a concentric O-ring groove 29 for mounting a face-sealing O-ring 31. Additionally, top flange 27 is provided with a concentric bolt circle of tapped holes.

Mirror image inwardly projecting bosses with transverse upper shoulders are located in the bore of mounting base 20. These bosses are provided with drilled and tapped mounting holes parallel to the axis of mounting base 20 in order to mount the controller assembly 40 of the lighting device 10.

Lantern lens assembly 30 is positioned on top of and coaxially with mounting base 20. Lens base 32 is an annular ring flange with a concentric bolt circle of holes corresponding to that of the top flange 27 of mounting base 20 and having a shallow counterbore on its under side. Radially projecting to one side of lens base 32 is lens hinge 33, which constitutes a rectangular tab having at its outer end a transverse eye hole formed in an outer end enlargement. The axis of the eye hole of lens hinge 33 is aligned with the transverse hinge holes in hinge bracket 24 of mounting base 20 when the lantern lens assembly 30 is aligned with and resting on the top flange 27 of the mounting base.

Thin walled lens body 35 has, from its lower end, an annular flange, a slowly tapering elongated large diameter frustro-conical main body portion, a short frustro-conical transition section of intermediate diameter, and a sharp small diameter conical bird spike 38 section at its top. All of the conical sections taper upwardly. The function of the bird spike 38 is to discourage birds from perching on and fouling the lens.

The exterior of the main body both above and below a central portion, termed the "bulls eye", is annularly grooved in a mathematically determined pattern which constitutes a standard fresnel lens 37 of the type conventionally used to focus light from a centrally located point or point source into a horizontal beam. The pattern of the annular grooves is approximately mirror imaged about the midplane of the bulls eye, but with slight modifications due to the conical pattern of the lens body.

Lens body 35 is positioned coaxially with lens base 32 with the bottom flange of the lens body retained within the counterbore of the lens base and held so that the bottom flange of the lens body may be clamped against the top flange 27 of the mounting base 20. O-ring 31 is positioned in groove 29 of the mounting base 20 and seals between the lens body 35 and the mounting base. When the lens body is positioned against the top flange 27, then lens closure screws 34, positioned in the bolt circle holes of lens base 32, are screwed into the threaded bolt circle holes of the top flange 27 of the mounting base, so that the lantern lens assembly is firmly mounted to the mounting base.

Figure 4:
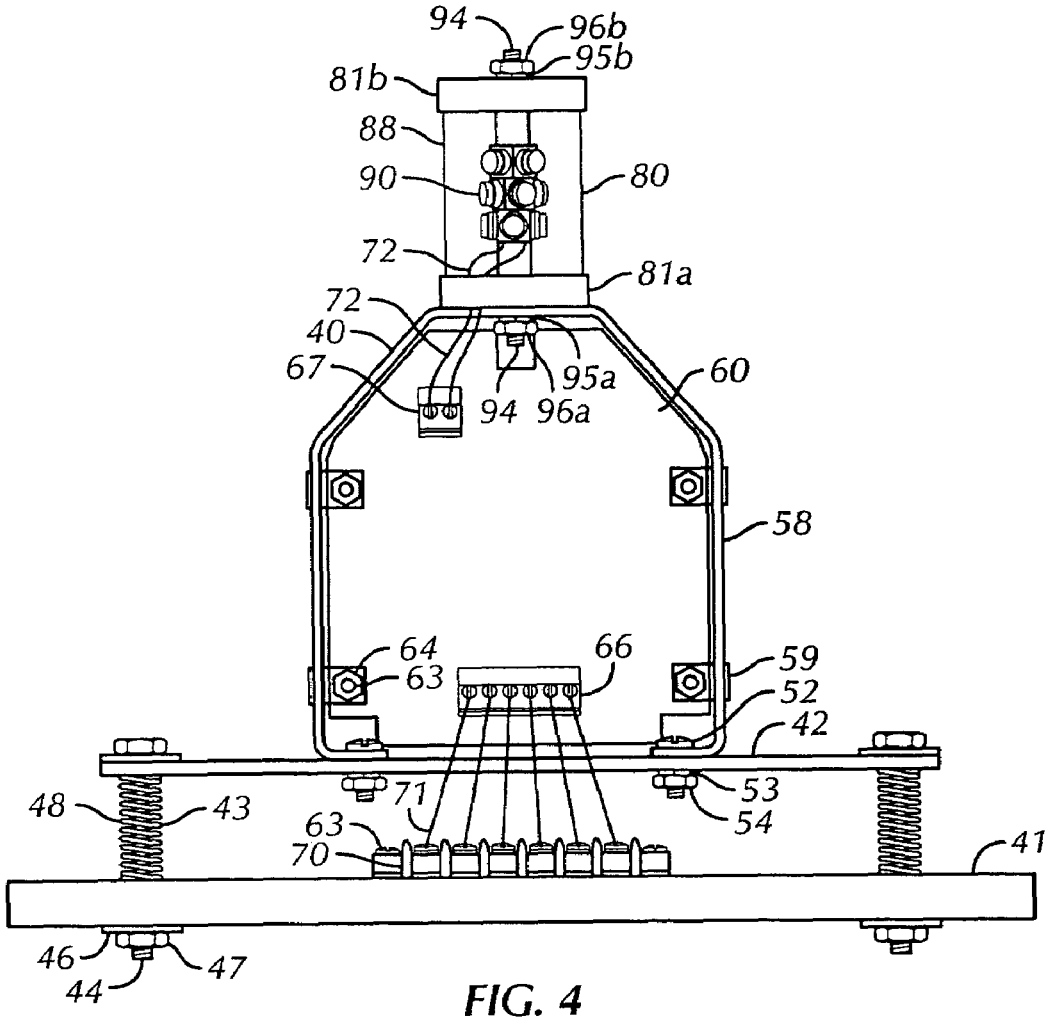
FIG. 4 shows a profile view showing details of the mounting of the controller and the light-emitting diode (LED) source assembly.
Figure 5:
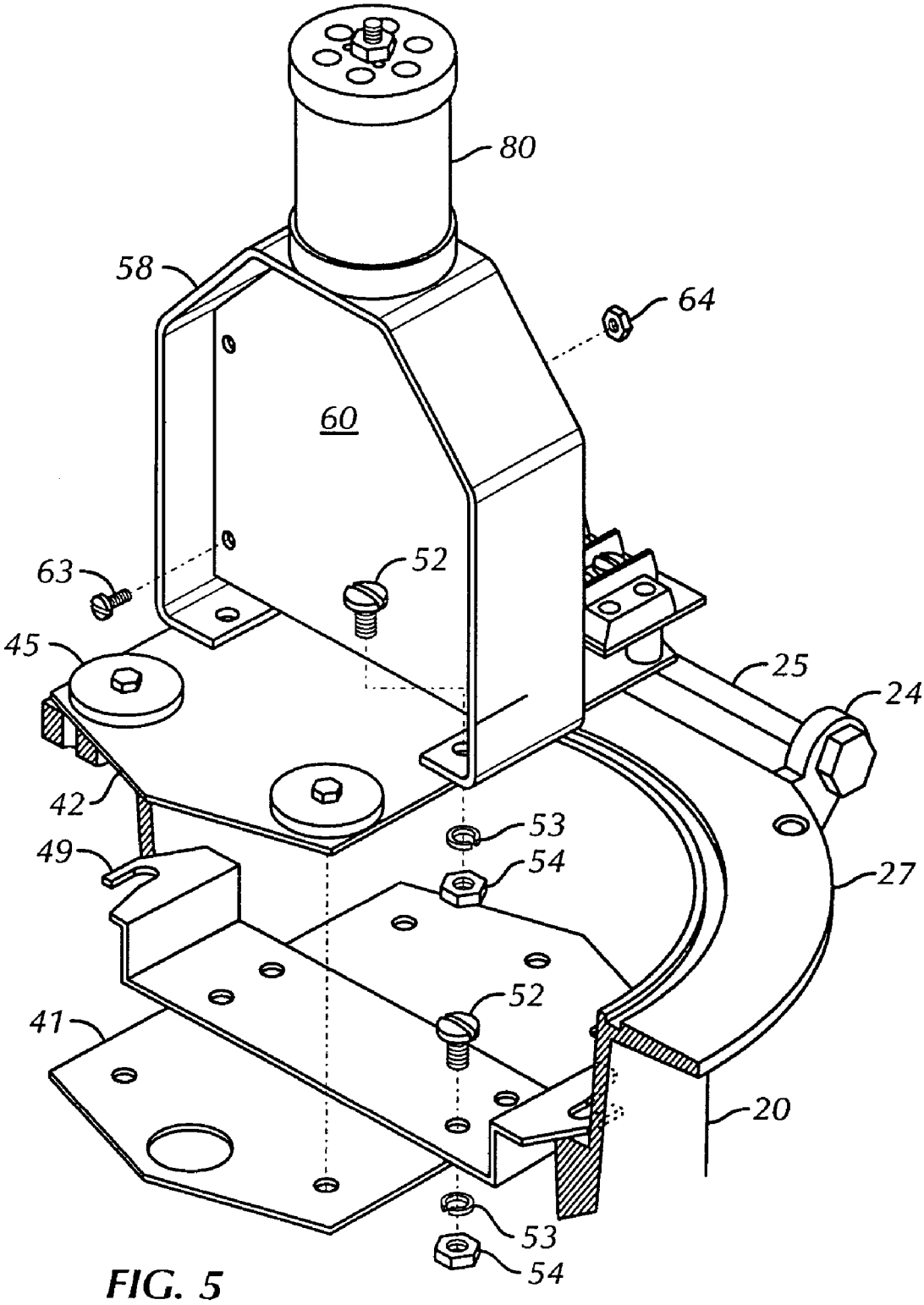
FIG. 5 is a partially exploded oblique view, partially in section, showing details of the mounting of the control unit for the lighting device.

Referring to FIGS. 4 and 5, the structure of one embodiment of the controller assembly 40 can be seen. FIG. 4 is a profile view showing the details of the shock resistant mounting of the controller assembly. The controller assembly 40 serves to provide appropriate, conditioned electrical power and, if desired, a programmable blinking pattern for the LED light sources.

Base plate 41 is a thin flat steel plate of hexagonal shape and dual symmetry with multiple mounting holes and access holes cut into it so that other components can be mounted to it and the mountings for other components can be accessed. Carrier plate 42 is similar to base plate 41, but with a different pattern of mounting holes and access holes. Carrier plate 42 is positioned parallel to and above base plate 41. Three or more spring mount assemblies 43 with their axes not lying on a common line are positioned in mounting holes on corresponding corners of base plate 41 and carrier plate 42 to support the carrier plate. As shown here, four spring mount assemblies are used herein. Spring mount assembly 43 consists of spring mount screw 44 with, in sequential order from the upper end, the head of screw 44, flat washer 45, the carrier plate 42, standoff spring 48, base plate 41, washer 46 and nylon insert lock nut 47. Washers 45 and 46, spring 48, and nut 47 are concentric with screw 44. The nut 47 is sufficiently threaded onto the screw 44 so that the spring 48 is preloaded in compression.

U-bracket 49 is formed from a strip of thin plate approximately 2 inches wide that has two outwardly projecting coplanar ears, each adjoining a symmetrical vertical leg, and a central horizontal section supported by the vertical legs. The outer ends of the ears of bracket 49 have similar but oppositely facing parallel slots transverse to the bracket longitudinal midplane. This is so that the bracket can be readily slipped in and out of engagement with vertically projecting headed screws mounted on the interior bosses of mounting base 20 by rotating it about its vertical axis without removal and reinstallation of the screws. U-bracket 49 is in turn rigidly mounted to the interior bosses in the bore of mounting base 20 by means of screws engaged in its slots.

Two sets of mounting holes for attaching the base plate 41 are located at either side of the central horizontal section of U-bracket 49. Base plate 41 is rigidly mounted in its center to the lower side of U-bracket 49 by screws 52, lock washers 53, and nuts 54 at two sets of holes on opposed sides of its central portion corresponding to the mounting holes in the central portion of bracket 49.

Printed circuit board (PCB) bracket 58, formed from a thin strip of plate, is symmetrical about its vertical midplane perpendicular to the plate strip longitudinal axis. The bracket has a horizontal central upper section adjoined by inclined segments, which are in turn attached to vertical legs that have inwardly projecting horizontal mounting tabs on their bottom ends. Bracket 58 is mounted in a central position to carrier plate 42 by means of two other sets of screws 52, lock washer 53, and nut 54.

Three mounting holes for the source LED assembly 80 are provided on the horizontal central upper section of bracket 58. One hole is in the middle of the horizontal central upper section and two others are symmetrically placed straddling the first hole.

Multiple PCB mounting tabs 59 are mounted in transverse slots pierced in the thin plate of bracket 58 and welded or soldered in place there. The controller PCB 60 is a flat construction of conventional printed circuit board material having a shape that closely fits within the interior of the PCB bracket 58. The individual components of the PCB 60 are not shown, but are substantially similar to those employed in the control circuitry of a conventional incandescent light beacon sold by Automatic Power, Inc., Houston, Tex.

If the incoming electrical power is AC, then it is rectified to DC on PCB 60. The input current and voltage are adjusted and regulated to provide appropriate polarities, voltages, current limits, and timing of any blinking functions desired for the type of LED light source used. The controller PCB is mounted to the tabs 59 by means of screws 63 and nuts 64. The PCB controller terminal strip 66 is rigidly mounted onto the lower end of controller PCB 60 on one side and the individual terminals of the PCB terminal strip are attached to appropriate conductor paths on controller PCB 60. Similarly, light emitting diode (LED) power terminal 67 with two terminals is mounted at the upper end of PCB 60 and is interconnected to appropriate circuit conductor paths on the printed circuit board.

Base terminal strip 70 is rigidly mounted to the upper surface of base plate 41 by means of screws 63 engaged in tapped holes in the base plate 41. Alternatively, base terminal strip 70 may be similarly mounted to carrier plate 42. The main leads 71 are discrete insulated wires that are each connected at their first end to one of the terminals of the base terminal strip 70 and at the second end at its corresponding terminal on the PCB terminal strip 66.

Figure 6:
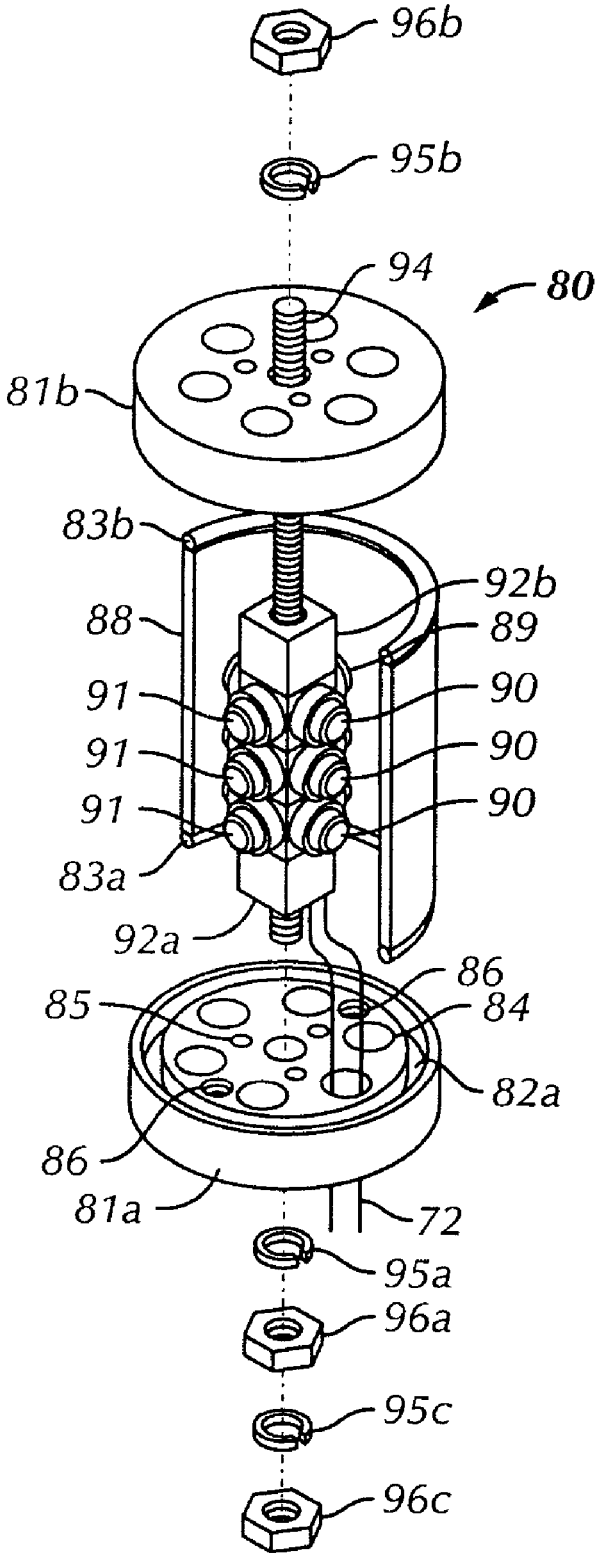
FIG. 6 is a partially exploded oblique view, partially in section, showing details of one embodiment of the source light-emitting diode (LED) assembly.

Multiple embodiments of the LED source assembly are possible with four such embodiments described below. The first embodiment of the LED source assembly 80, shown in the exploded view of FIG. 6, consists primarily of housing elements for the LED assembly 89 and the LED assembly itself. This embodiment is most suitable for use with one to two Watt high flux LED light sources, which generate less heat than the the five Watt high flux LED sources. Generally when five Watt LEDs are used in this embodiment, a portion of the LEDs are driven at a lower power than the other LEDs to save energy and to allow an overall cooler operation of the LED source assembly as described in more detail below.

Bottom base 81*a* is a right circular disk having a central axial through hole and a concentric annular O-ring face seal groove 82*a* having a depth in excess of that necessary to properly house O-ring 83*a* on its upper surface. Base 81*a* also has an equispaced array of multiple primary vent holes 84 located on a first radius, an equispaced array of multiple secondary vent holes 85 smaller than holes 84 and located on a smaller second radius, and two threaded holes 86 in diametrically opposed positions for the purpose of providing an optional mounting of the source LED assembly 80. All of the holes 84, 85, and 86 are parallel to the axis of disk 82*a*. The threaded holes 86 are spaced similarly to those straddling the central hole on the horizontal central upper section of bracket 58.

Upper base 81*b*, which is inverted relative to lower base 81*a*, is substantially identical to the lower base except for the optional omission of threaded holes 86. The O-ring groove 82*b* of upper base 81*b* houses O-ring 83*b*.

Diffuser 88 is a right circular thin walled tube made of plastic, glass or any other material that is clear, heat resistant and satisfies the structural and optical requirements of the diffuser 88. Preferably, the diffuser 88 is made of fused quartz or borosilicate or crown glass or a similar optically clear, heat resistant glass. The inner diameter of diffuser 88 is greater than the inside diameter of O-ring groove 82*a*, and the outer diameter of the diffuser is a close fit to the inner diameter of groove 82*a* so that the diffuser may be positioned concentrically with the base 81*a*.

The diffusion properties of the diffuser 88 result from a roughened microfinish on at least one of the surfaces of the diffuser 88 that surrounds the LED source assembly. As the random lay pattern of one or more surfaces of the diffuser 88 is increased, the uniformity of the light emitted from the diffuser also increases. For example, in one embodiment the inner bore of diffuser 88 is smooth, while the outer cylindrical surface of diffuser 88 is dentated, such as being uniformly frosted by sand blasting or other suitable means, so that the roughened outer surface has a statistically consistent random pattern of microfacet angles. Alternatively, the inner bore may be dentated or frosted rather than the outer surface, or both the inner and outer surfaces may be frosted.

The dentated surface of the diffuser is able to refract incoming light emanating from the LEDs 91 in such a manner that the intensity of the light emitted from the diffuser, as measured in spherical coordinates, is substantially uniformized for the angles of admissivity of the fresnel lens in combination with LED source assembly 80. This substantial uniformization is demonstrated by the measured results shown in FIG. 20, wherein the emitted light intensity on the horizontal midplane of the LED source assembly is shown both without and with the diffuser 88.

As an alternative, the inner bore of diffuser 88 may be frosted, rather than the outer surface, with the resultant diffusion and substantial uniformization of the emitted light being similar to that for the frosting on the outer surface.

Figure 9:
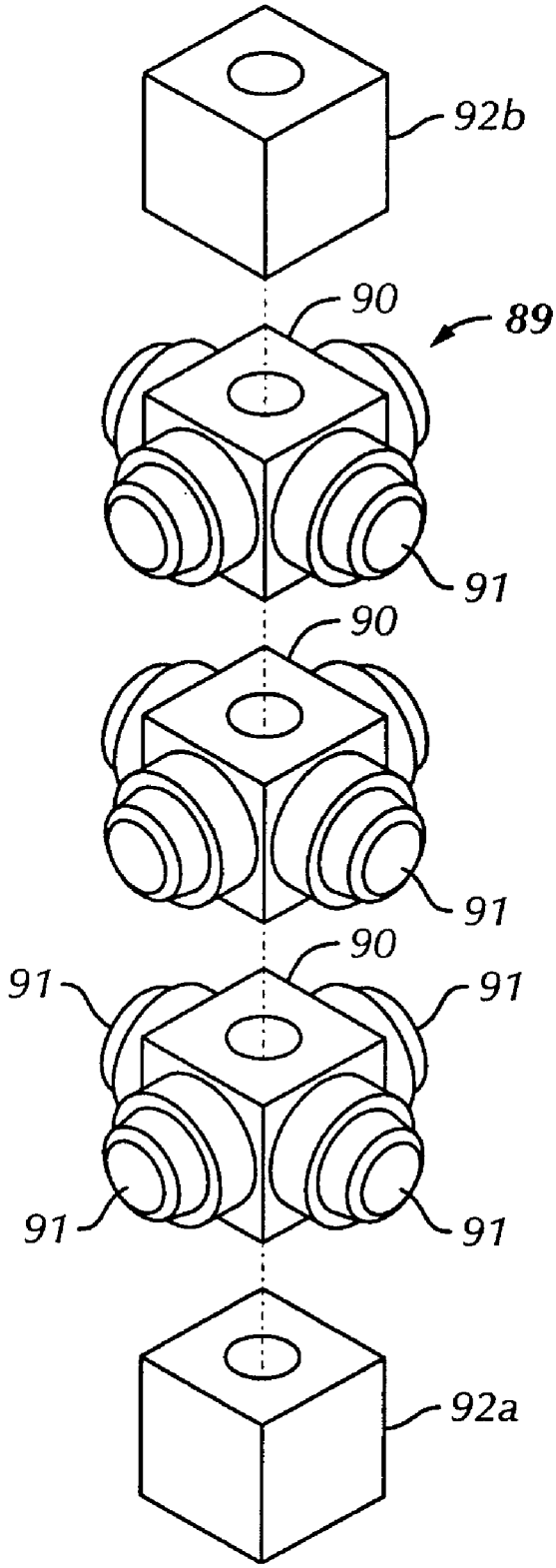
FIG. 9 is an oblique exploded view of the LED assembly of the embodiment of the source LED module shown in FIG. 6.
Figure 10:
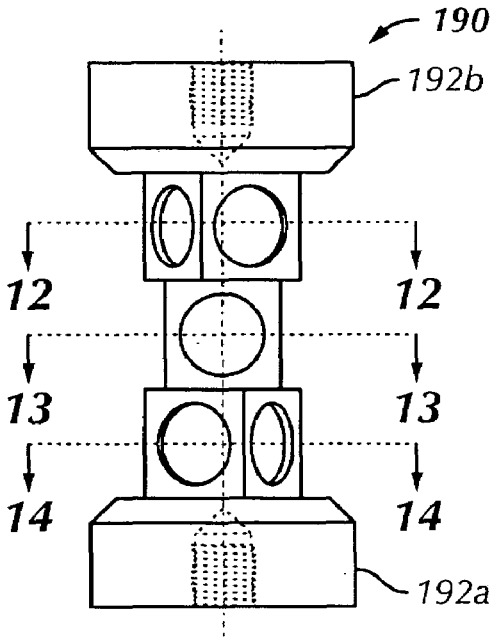
FIG. 10 is a profile view of the LED mounting block of the embodiment of the source LED module shown in FIG. 7.
Figure 11:
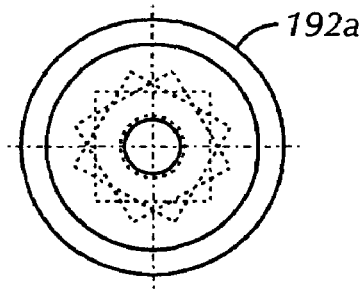
FIG. 11 is a plan view of the LED mounting block of the embodiment of the source LED module shown in FIG. 7.

The LED assembly 89, shown in an exploded view in FIG. 9, and used in the first embodiment of the LED source assembly 80, is characterized by three sets of LED modules 90, wherein each LED module is an aluminum alloy right angle prism with a square horizontal cross-section. Each LED module 90 mounts four outwardly projecting light source LEDs 91 at its mid height, with one LED centrally positioned on each of its vertical sides.

Each of the LEDs 91 is attached to its respective face of its module 90 with an adhesive such as Loctite Product Output 315, which is a high temperature thermally conductive one-part acrylic adhesive, or a one or two-part epoxy. If an epoxy is used it is preferably compounded with a filler such as aluminum nitride or silver to enhance the thermal conductivity of the adhesive bond so that it will readily conduct heat into the body of the module 90.

Each of the LED modules 90 has a vertical through hole on its axis of symmetry. Filler blocks 92*a,b* are constructed identically to the LED modules 90, but do not have any LEDs attached. Filler blocks 92*a* and 92*b* are respectively located above and below the set of three LED modules 90. All of the LED modules 90 and the filler blocks 92*a,b* are aligned with their vertical sides parallel.

Figure 21:
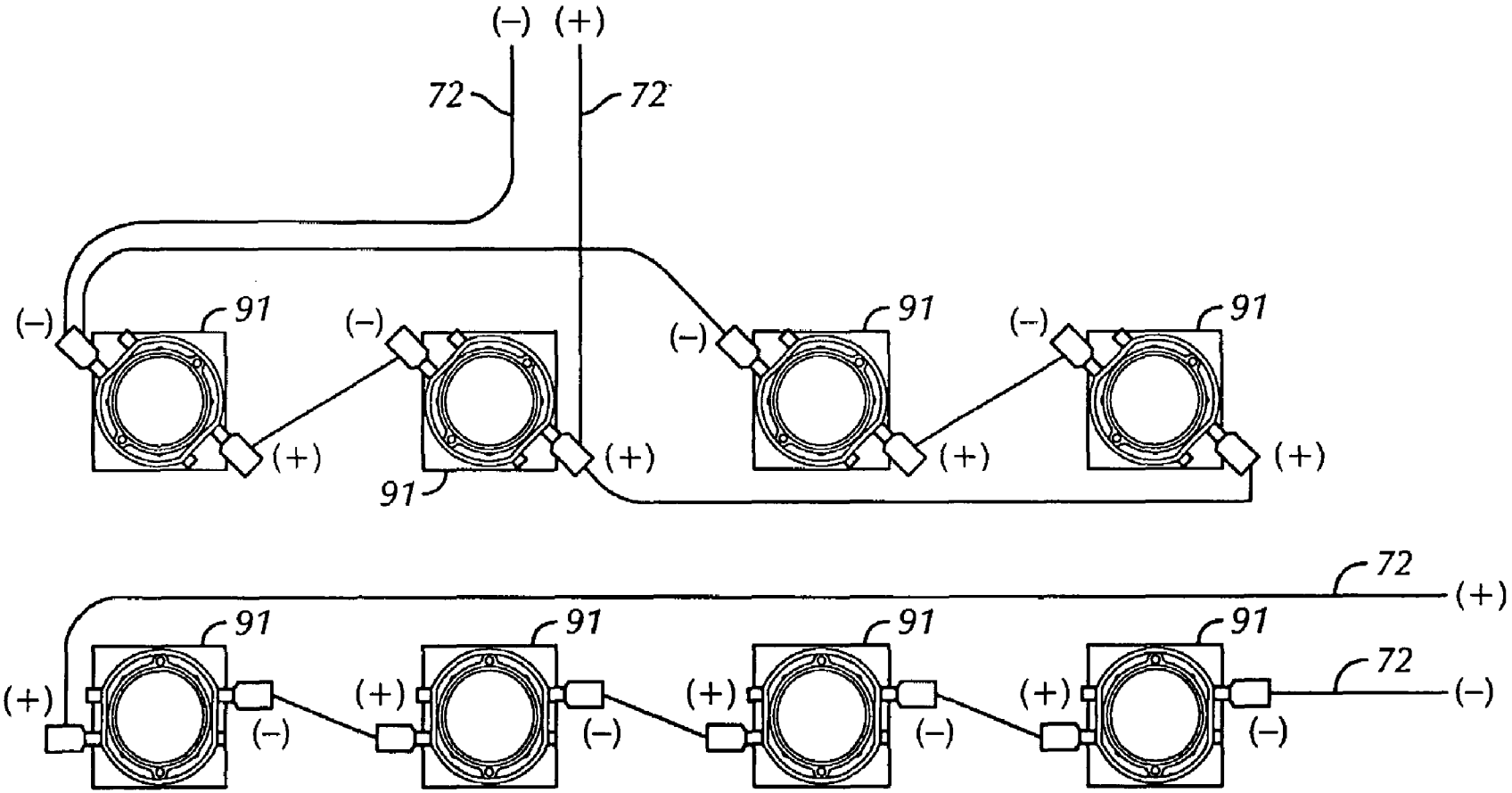
FIG. 21 is a semi-schematic view that illustrates the preferred interwiring of the LEDs as a function of their color and required input voltages.

The bottom LED module 90 is connected by two insulated wire jumpers 72 attached to the terminals of LED power terminal 67 on controller PCB 60 so that electric power can be transmitted to the LED light sources for the lighting device 10. The jumpers 72 are passed through one of the primary vent holes 84 of base 81*a*. The four individual LEDs 91 within a given LED module 90 are electrically interconnected in series or in parallel serial pairs and the individual LED modules are also connected in parallel, all by small wires that are not shown in FIG. 6 for reasons of clarity. One possible wiring scheme is shown in FIG. 21. The required wiring pattern depends on the operating voltages needed for the particular type and color of high flux LED being used.

The entire LED source assembly 80 is arranged in the following pattern. From the bottom, the bottom base 81*a* has the LED assembly 89 concentrically placed with the bottom of filler block 92*a* in firm contact with the upper surface of base 81*a*. Upper base 81*b* is then concentrically placed relative to lower base 81*a* where its grooved lower surface is in firm contact with the top of filler block 92*b* of the LED assembly 89. The firm contact ensures good thermal conductivity across the connections and permits heat absorbed by the modules 90 to flow to the bases 81*a,b*. The firm contact is maintained by clamping the entire LED source assembly 80 by means of thread rod 94. Thread rod 94 is inserted through the central bore of bases 81*a,b* and LED assembly 89 and holds the LED assembly 89 together by tightening lower lock washer 95*a* and nut 96*a* onto rod 94 as it extends out the bottom of the assembly, and upper lock washer 95*b* and nut 96*b* onto rod 94 as it passes out the top of the assembly.

Before assembly, O-ring 83*a* is placed in groove 82*a* of lower base 81*a*, O-ring 83*b* is placed in groove 82*b* of upper base 81*b*. The diffuser 88 is then positioned between and concentric with the two bases. The length of diffuser 88 is selected such that the O-rings 83*a,b* are compressed sufficiently to provide sealing but at the same time are not over compressed whenever thread rod 94 and the nuts 96*a,b* are used to clamp the LED assembly between the bases 81*a,b*.

LED source assembly 80 is mounted to the center mounting hole of the horizontal central upper section of bracket 58 by means of lock washer 95*c* and nut 96*c*, which threadedly connect to the bottom end of thread rod 94 so that bracket 58 is clamped between nut 96*a* and nut 96*c*. An air circulation path is shown between the lower base 81*a* and bracket 58 due to the gap created by the presence of washer 95*a* and nut 96*a*. Cooling air thus may circulate as a result of thermally induced convection in through vent holes 84 and 85 in base 81*a*, between LED assembly 89 and diffuser 88, and out through vent holes 84 and 85 in upper base 81*b*. Although an air circulation path is shown in this embodiment, the LED source assembly may be sealed to protect the LEDs from moisture. Whenever the LED assembly is sealed, the conduction of generated heat through the heat sink to the environment is even more important.

Figure 7:
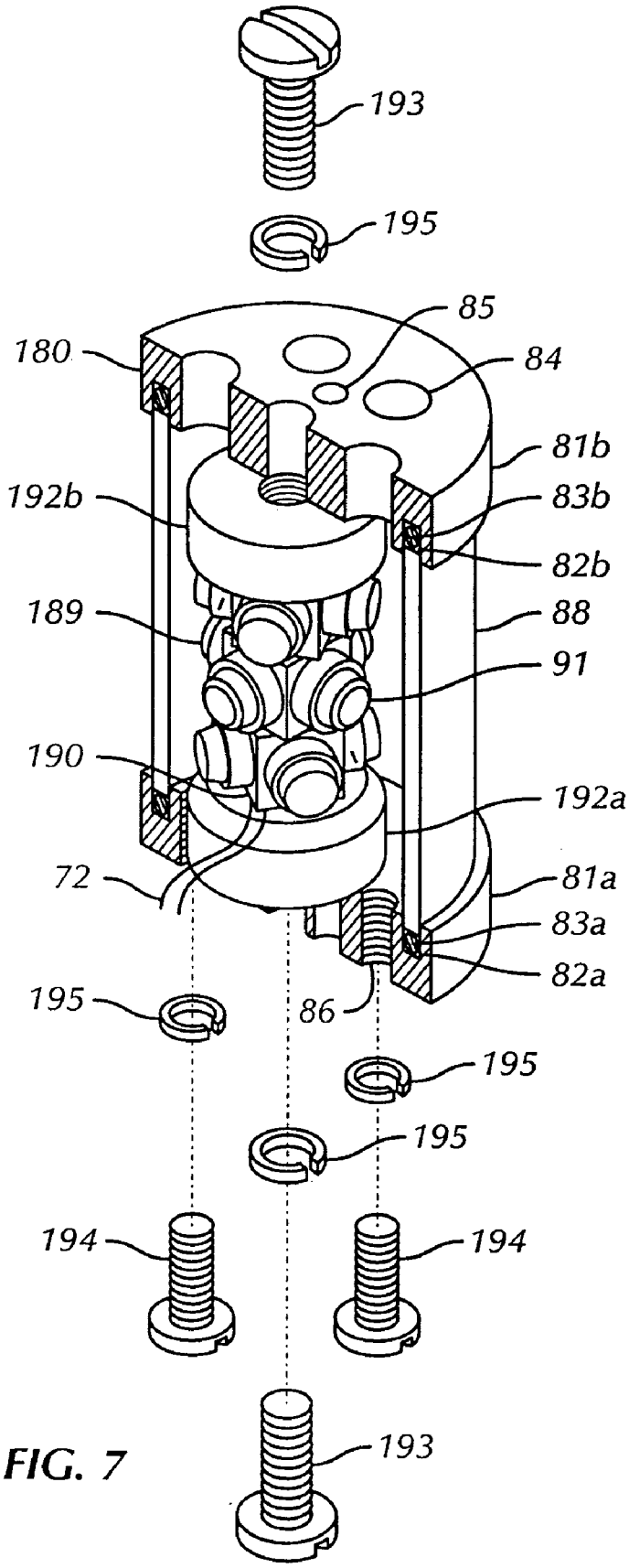
FIG. 7 is a partially exploded oblique view, partially in section, showing details of another embodiment of the source LED module.

The second embodiment of the LED source assembly 180, shown in FIG. 7, uses a different arrangement for the LED assembly, but in most other ways closely resembles the first embodiment 80 in the arrangement of the housing for the LED source. This embodiment provides an improved angular uniformity of light output in the horizontal midplane of the lighting device as a consequence of having one of the total of twelve LED sources emitting light in each of the 30° sectors of the horizontal plane.

The second embodiment of the LED source assembly, shown in FIG. 7, is designed to be a direct replacement for that used in the first embodiment, so that it can directly mount to the top of bracket 58 and be operated by the same controller assembly 40 and use the same mounting base 20 and lantern assembly 30. LED source assembly 180 utilizes the same lower and upper bases 81*a,b*, O-rings 83*a,b*, and diffuser 88 as were used in the first embodiment 80. For the second embodiment, the LED assembly 189 has the same height as LED assembly 89 of the first embodiment, but the construction differs as follows.

Figure 12:
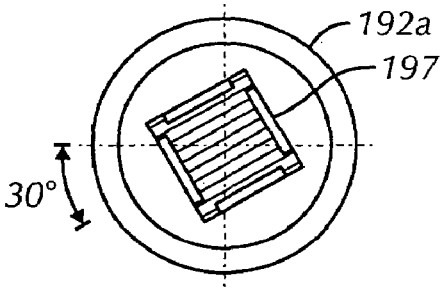
FIG. 12 is a transverse cross-sectional view, cut on the section line 12—12 shown in FIG. 10, of the LED mounting block of the source LED module.
Figure 13:
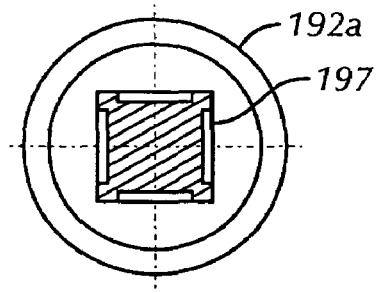
FIG. 13 is a transverse cross-sectional view, cut on the section line 13—13 shown in FIG. 10, of the LED mounting block of the source LED module.
Figure 14:
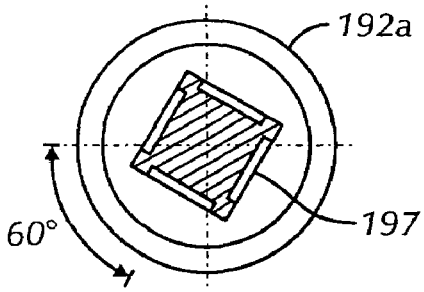
FIG. 14 is a transverse cross-sectional view, cut on the section line 14—14 shown in FIG. 10, of the LED mounting block of the source LED module.

FIGS. 10–14 show the construction details of LED module block 190, which is made from a single piece of aluminum alloy. The LED module block 190 has at each end identical, integral, concentric right circular heat sink disks 192*a,b* which have thicknesses equal to approximately one half diameter of the disks. The diameter of the heat sink disks 192*a,b* is approximately 75% to 80% of the inner diameter of diffuser 88, so that when module block 190 is assembled concentrically with the bases 81*a,b*, the primary vent holes 84 of the bases are not blocked by the module block. The distal ends of the disks each have coaxial holes drilled to less than the thickness of the disk and are then tapped. The interior ends of the disks are chamfered. The central portion of LED module block 190 is composed of three different right angle prisms with identical square horizontal cross-sections. When viewed from above, the middle right angle prism is rotated 30° clockwise, as shown in FIG. 12, and the top right angle prism is rotated 60° clockwise, as shown in FIG. 14, about the vertical axis of the LED module block 190 relative to the bottom prism. The bottom end of the bottom right angle prism adjoins the interior upper end of disk 192*a*, while the top end of the upper right angle prism adjoins the interior lower end of disk 192*b*. Each of the twelve faces of the set of three right angle prisms has a shallow, flat-bottomed blind hole 197 positioned in the center of its vertical face.

Each right angle prism of the LED module block 190 mounts an outwardly projecting light source LED 91 in each of the pockets formed by the holes 197. As a result, one LED projects radially every 30° about the vertical axis of block 190. Each of the LEDs 91 is attached to its respective face of the module 190 with an adhesive such as Loctite Product Output 315, which is a high temperature thermally conductive one-part acrylic adhesive or a one or two-part epoxy compounded with a filler such as aluminum nitride or silver to enhance the thermal conductivity of the adhesive bond.

One of the bottom tier of LEDs 91 is connected as before by two insulated wire jumpers 72 attached to the terminals of LED power terminal 67 on controller PCB 60 so that electric power can be transmitted to the LED light sources for the lighting device 10. The jumpers 72 are passed through one of the primary vent holes 84 of base 81*a*. The individual LEDs 91 on a given right angle prism of LED module 190 are electrically interconnected in series or in parallel serial pairs and one of the LEDs on each of the individual tiers is also connected in parallel to another LED on its adjacent tier or tiers, all by small wires which are not shown in FIG. 7 for reasons of clarity. The wiring pattern is dependent on the operating voltages needed for the particular type and color of high flux LED being used.

Upper base 81*b* is then concentrically placed relative to lower base 81*a*. The grooved lower surface of the upper base 81*b* is in firm contact with the top of the LED module 190 and the grooved upper surface of the lower base 81*a* is in firm contact with the bottom of the LED module 190. The firm contact between the bases 81*a,b* and the LED assembly 189 ensures good thermal conductivity across the connections and permits heat absorbed by the module 190 to flow to the bases 81*a,b*. The firm contact is maintained by clamping the entire LED source assembly 180 by means of screws 193 and lock washers 195 inserted through the central bore of bases 81*a,b* and threadedly connected to the threaded holes on the lower and upper ends of LED module block 190.

LED source assembly 180 is mounted to the spaced apart mounting holes of the horizontal central upper section of bracket 58 by means of pairs of screws 194 and lock washers 195, which threadedly connect to the threaded holes 86 on the bottom end of base 81*a* so that bracket 58 is clamped between the head of the clamping screw 193 the bottom face of base 81*a*.

An air circulation path is shown between the lower base 81*a* and bracket 58 due to the gap created by the presence of washer 195 and screw 193. Cooling air thus may circulate as a result of thermally induced convection in through vent holes 84 and 85 in base 81*a*, between LED assembly 189 and diffuser 88, and out through vent holes 84 and 85 in upper base 81*b*. Although an air circulation is shown in this embodiment, the LED source assembly may be sealed to protect the LEDs from moisture. Whenever the LED assembly source is sealed, the transference of the heat through the heat sink away from the LEDs becomes even more important.

Figure 8:
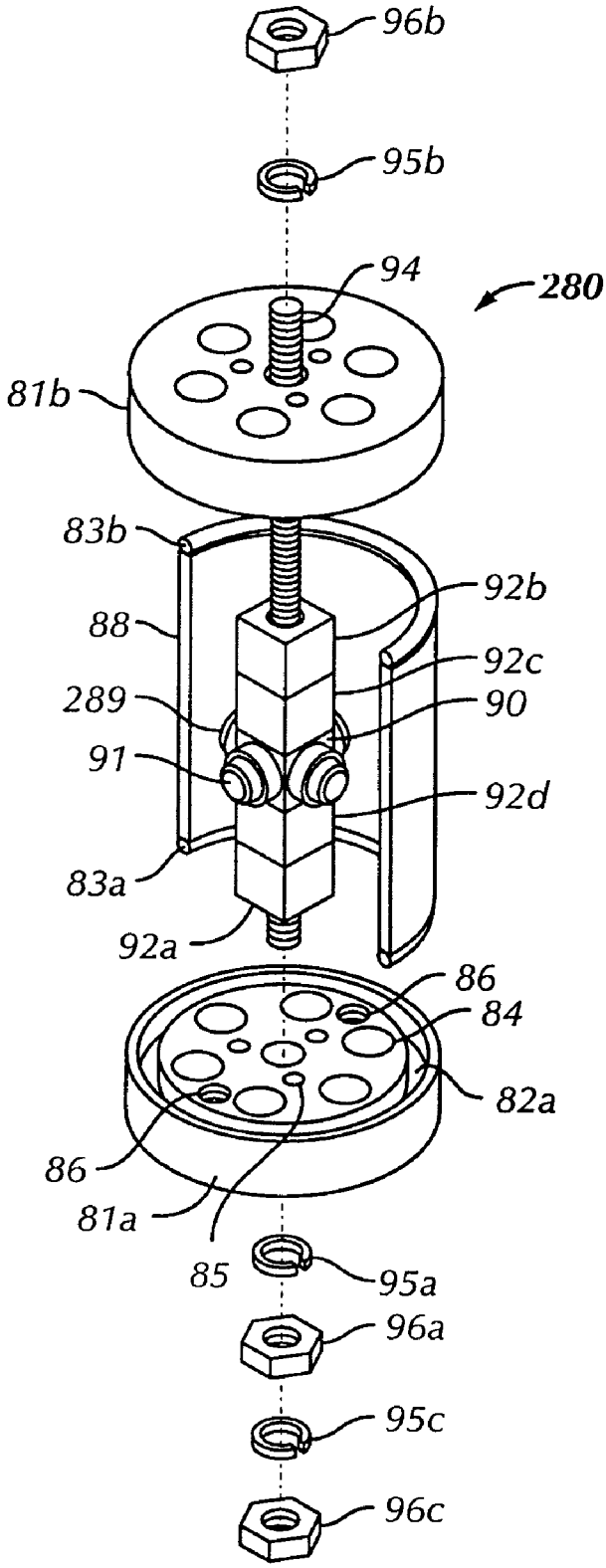
FIG. 8 is a partially exploded oblique view, partially in section, showing details of yet another embodiment of the source LED module.

The third embodiment of the LED source assembly 280, shown in FIG. 8, uses a different arrangement for the LED assembly, but in most other ways closely resembles the first embodiment 80 in the arrangement of the housing for the LED source. The third embodiment of the LED source assembly is designed to be a direct replacement for that used in the first embodiment, so that it can directly mount to the top of bracket 58 and be operated by the same controller assembly 40 and use the same mounting base 20 and lantern assembly 30. LED source assembly 280 utilizes the same lower and upper bases 81*a,b*, O-rings 83*a,b*, and diffuser 88 as were used in the first embodiment 80. For the third embodiment, the LED assembly 289 has the same height as LED assembly 89, but the construction is as follows.

FIG. 8 shows the construction details of LED assembly 289, which is assembled from one LED module 90, wherein the LED module is an aluminum alloy right angle prism with a square horizontal cross-section. The LED module 90 mounts four outwardly projecting light source LEDs 91 at its mid height, with one LED centrally positioned on each of its vertical sides. Each of the LEDs 91 is attached to its respective face of its module 90 with an adhesive such as Loctite Product Output 315, which is a high temperature thermally conductive one-part acrylic adhesive. Alternatively, a one or two-part epoxy, compounded with a filler such as aluminum nitride or silver to enhance the thermal conductivity of the adhesive bond so that it will readily conduct heat into the body of the module 90, may be used.

The LED module 90 has a vertical through hole on its axis of symmetry. Filler blocks 92*a,b* are constructed identically to the LED modules 90, but do not have any LEDs attached. Filler block pair 92*a* and 92*d* and pair 92*b* and 92*c* are respectively located below and above the LED module 90. The LED module 90 and the filler blocks 92*a,b,c,d* are aligned with their vertical sides parallel. Two insulated wire jumpers 72 connect the LED module 90 to the terminals of LED power terminal 67 on controller PCB 60 so that electric power can be transmitted to the LED light sources for the lighting device 10. The jumpers 72 are passed through one of the primary vent holes 84 of base 81*a*. The four individual LEDs 91 within the LED module 90 are electrically interconnected in series or in parallel serial pairs, all by small wires that are not shown in FIG. 8 for reasons of clarity. The required wiring pattern is dependent on the operating voltages needed for the particular type and color of high flux LED 91 being used.

The entire LED source assembly 280 is arranged in the following pattern. From the bottom, the bottom base 81*a* has the LED assembly 289 concentrically placed with the bottom of filler block 92*a* in firm contact with base 81*a* on its upper surface. Upper base 81*b* is then concentrically placed relative to lower base 81*a* where its grooved lower surface is in firm contact with the top of filler block 92*b* of the LED assembly 289. The firm contact ensures good thermal conductivity across the connections and permits heat absorbed by the modules 290 to flow to the bases 81*a,b*. The firm contact is maintained by clamping the entire LED source assembly 280 by means of thread rod 94, inserted through the central bore of bases 81*a,b* and LED assembly 289, lower lock washer 95*a* and nut 96*a* threadedly connected to rod 94 on the bottom of the assembly, and upper lock washer 95*b* and nut 96*b* threadedly connected to rod 94 on the top of the assembly.

Before assembly, O-ring 83*a* is placed in groove 82*a* of lower base 81*a*, O-ring 83*b* is placed in groove 82*b* of upper base 81*b*, and diffuser 88 is positioned between and concentric with the two bases. The length of diffuser 88 is selected such that the O-rings 83*a,b* are compressed sufficiently to provide sealing but at the same time are not over compressed whenever thread rod 94 and the nuts 96*a,b* are used to clamp the LED assembly between the bases 81*a,b*.

LED source assembly 280 is mounted to the center mounting hole of the horizontal central upper section of bracket 58 by means of lock washer 95*c* and nut 96*c*, which threadedly connect to the bottom end of thread rod 94 so that bracket 58 is clamped between nut 96*a* and nut 96*c*. An air circulation path is shown between the lower base 81*a* and bracket 58 due to the gap created by the presence of washer 95*a* and nut 96*a*. Cooling air thus may circulate as a result of thermally induced convection in through vent holes 84 and 85 in base 81*a*, between LED assembly 289 and diffuser 88, and out through vent holes 84 and 85 in upper base 81*b*. Although an air circulation path is shown, the LED source assembly may also be sealed to protect the LEDs from moisture.

Figure 15:
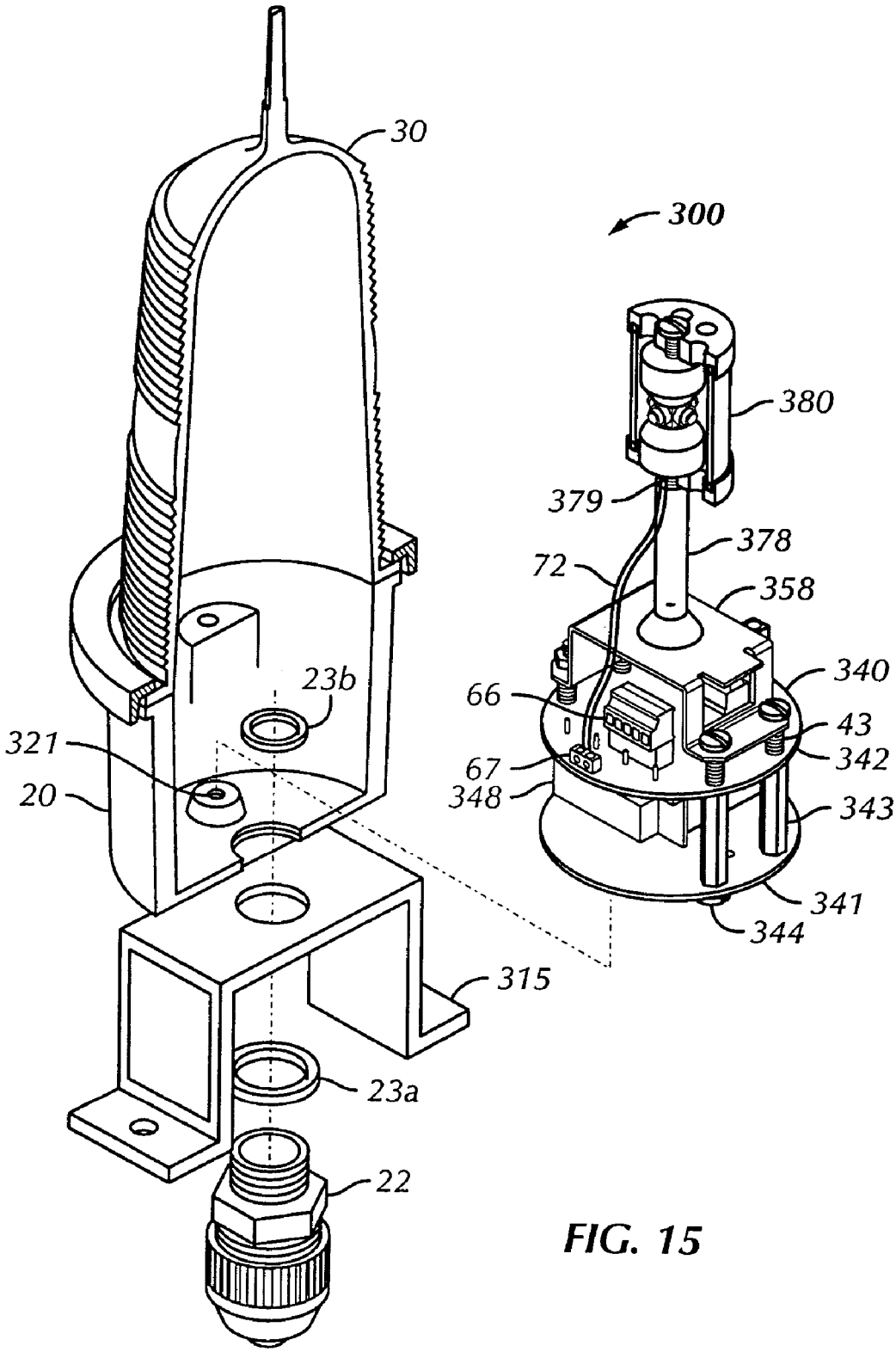
FIG. 15 is a partially exploded oblique view, partially in section, showing details of an alternative embodiment of the control unit with a fourth embodiment of a source LED module.

Another embodiment of the lighting device 300 of the present invention is shown in an oblique partially exploded sectional view in FIG. 15. In this embodiment, the mounting base 20 and lantern assembly 30 which house the components are the same as in the first embodiment shown in FIGS. 1 and 2, as is the sealing cable fitting 22. The lighting device 300 in this case is mounted on a hat-shaped bracket 315 by means of sealing cable fitting 22, which is screwed into the bottom of the mounting base 20 by means of its central threaded hole and sealed by means of gasket 23*a* which closes the possible leak paths between the fitting, the mounting base, and the bracket 315. Hatshaped bracket has an elevated horizontal central portion with a central vertical axis hole for fitting 22, symmetrical vertical legs, and outwardly extending horizontal ears with mounting holes for attachment to a supporting piling. The input power cable for the lighting device 300, which is not shown here, enters the interior of the lighting device 300 by means of the sealing fitting 22. This arrangement, without a battery box or solar collector, is typically used with a remote AC power source.

While controller assembly 340 performs substantially the same functions as the controller assembly 40 in the first embodiment of the lighting device 10, controller 340 is configured differently. Base plate 341 is a thin circular plate which is attached by screws in holes in plate 341 to coaxial threaded holes in multiple bosses 321 which are on the upper side of the bottom transverse bulkhead 21 of the mounting base 20. Carrier plate 342 is a thin circular printed circuit board (PCB) similar in its geometry to plate 341. It is mounted coaxially with and spaced apart above plate 341 by means of multiple identical standoffs 343, screws 344 on the connection of the standoffs with plate 341, and the screws of spring mount assemblies for the connection of the standoffs with plate 342. Similar holes are provided on the same pattern on the periphery of each of plates 341 and 342 in order to accommodate the screws attaching to the standoffs.

Carrier plate 342 mounts power supply assembly 348 on its lower side for rectifying AC power to DC if necessary and conditioning the power output by power supply 348 by providing voltage stepdown and regulation. The power supply 348 also provides appropriate polarities, current limits, and surge protection as required. The other individual components of the PCB on plate 342 are not shown, but are substantially similar to those employed in the control circuitry of the conventional incandescent light beacon device sold by Automatic Power, Inc., Houston, Tex.

The PCB board of carrier plate 342 also provides the timing of any typical blinking functions desired for the type of LED light source used. The PCB controller terminal strip 66 is rigidly mounted onto the upper side of controller on the PCB of carrier plate 342 on one side and the individual terminals of the PCB terminal strip are attached to appropriate conductor paths on the PCB. Similarly, light emitting diode (LED) power terminal 67 with two terminals is mounted on the upper side of the PCB and is interconnected to appropriate circuit conductor paths on the printed circuit board. The leads of the input power cable, not shown here, are connected to the appropriate terminals of terminal strip 66 in order to power the circuit board.

Hat-section bracket 358 is centrally mounted above the carrier plate 342 by means of spring mount assemblies 43 so that it is shock isolated from the rest of the controller assembly 340. Bracket 358 has a horizontal central section, two similar, parallel vertical sides, and coplanar outwardly projecting mounting ears. Multiple holes coaxial with similar holes in carrier plate 342 serve to provide mounting locations for the spring mount assemblies 43. A tab is cut out of the central portion of one of the vertical sides by making cuts on the vertical sides and bottom of the tab. The tab is then bent upwardly so that it projects horizontally as a projection of the central horizontal section of bracket 358. A hole is punched close to the hinge line for the tab and supercapacitor is mounted therein.

Figure 16:
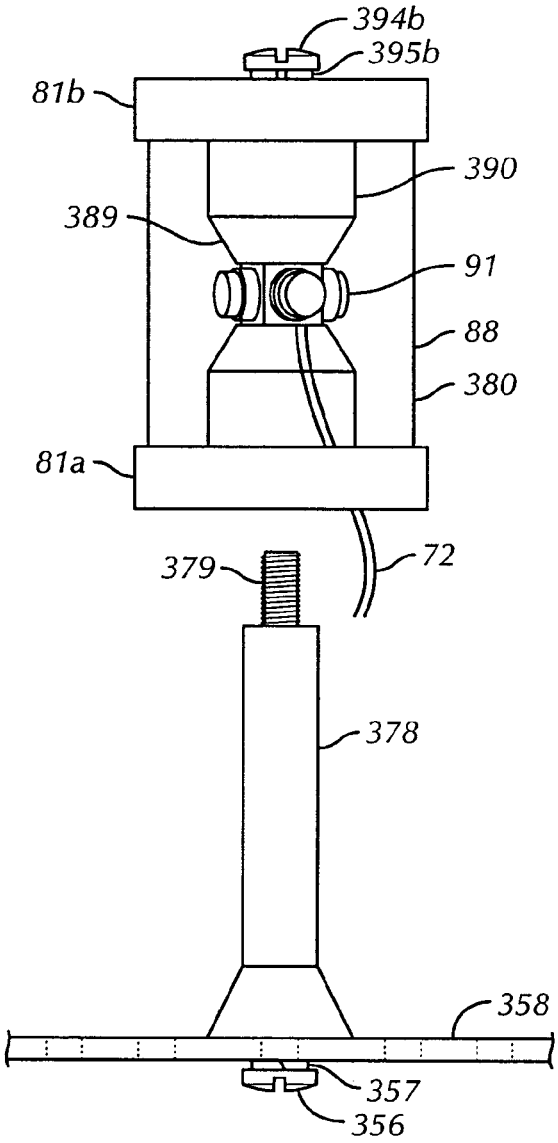
FIG. 16 is a profile view showing details of the mounting of the source LED module of FIG. 15 onto the control unit.

Referring to FIG. 16, pylon 378 is mounted to a centrally positioned hole in the horizontal central section of bracket 358 by means of screw 356 and lock washer 357, which are threadedly engaged with a tapped axial hole on the bottom end of the pylon. Pylon 378 has a short frustro-conical enlarged base and an extended cylindrical shank. The upper end of pylon 378 is turned down and threaded to form projecting coaxial screw end 379. LED source assembly 380 is supported on pylon assembly 378 by means of inserting screwing screw end 379 into the axial hole of base 81*a* and thence threading it into the axial tapped hole in the bottom of LED module block 390.

Upper base 81*b* is then concentrically placed relative to lower base 81*a*. The grooved lower surface of the upper base 81*b* is in firm contact with the top of the LED module 390 and the grooved upper surface of the lower base 81*a* is in firm contact with the bottom of the LED module 390. The firm contact between the bases 81*a,b* and the LED assembly 389 ensures good thermal conductivity across the connections and permits heat absorbed by the module 390 to flow to the bases 81*a,b*. The firm contact is maintained on the top side by clamping the entire LED source assembly 380 by means of screws 394*b* and lock washers 395*b* inserted through the central bore of bases 81*b* and threadedly connected to the threaded holes on the upper ends of LED module block 390. The firm contact is maintained on the bottom side by screwing screw end 379 into the axial hole of base 81*a* and into the bottom of LED module block 390.

LED source assembly 380, the fourth embodiment of the LED source assembly shown in FIG. 16, is designed to be a direct replacement for the first embodiment of the LED source assembly 80. LED source assembly 380 utilizes the same lower and upper bases 81*a,b*, O-rings 83*a,b*, and diffuser 88 as were used in the first embodiment of the LED source assembly 80. For the fourth embodiment, the LED assembly 389 has the same height as LED assembly 89 of the first embodiment, but the construction differs as follows.

Figure 17:
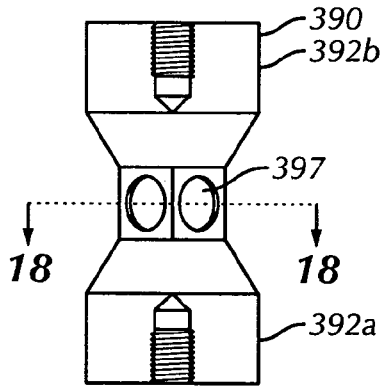
FIG. 17 is a profile view of the LED module block of the source LED module of FIG. 15.
Figure 18:
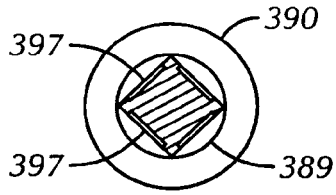
FIG. 18 is a transverse cross-sectional view of the LED module block of FIG. 17.

FIGS. 17 and 18 show the construction details of LED module block 390, which is made from a single piece of aluminum alloy. The LED module block 390 has at each distal end identical, integral, concentric right circular heat sink disks 392*a,b* that have thicknesses equal to approximately 75% of the diameter of the disks. The diameter of the heat sink disks 392*a,b* is approximately 75% to 80% of the inner diameter of diffuser 88, so that when module block 390 is assembled concentrically with the bases 81*a,b*, the primary vent holes 84 of the bases are not blocked by the module block 390.

The distal ends of the heat sink disks 392*a,b* have coaxial holes drilled to less than the thickness of the disk and then tapped. The interior ends of the heat sink disks 392*a,b* are chamfered, with the minimum diameter of the chamfers equal to the diagonal dimension of the central portion of the LED module block 390. The central portion of LED module block 390 is composed of a cubic or nearly cubic right angle prism with a square horizontal cross-section. The bottom end of the right angle prism adjoins the chamfered interior upper end of disk 392*a*, while the top end of the upper right angle prism adjoins the chamfered interior lower end of disk 392*b*. Associated with each face of the right angle prism is a pair of horizontal arcuate flats, one at the prism bottom and one at the prism top, which are the transitions between the chamfered shoulders and the right angle prism. Each of the four faces of the right angle prism has a shallow, flat-bottomed blind hole 397 positioned in the center of its vertical face.

The right angle prism of the LED module block 390 mounts an outwardly projecting light source LED 91 in each of the pockets formed by the holes 397. As a result, one LED projects radially every 90° about the vertical axis of block 390. Each of the LEDs 91 is attached to its respective face of the module 390 with an adhesive such as Loctite Product Output 315, which is a high temperature thermally conductive one-part acrylic adhesive or a two-part epoxy compounded with a filler such as aluminum nitride or silver to enhance the thermal conductivity of the adhesive bond.

One of the LEDs 91 is connected as before by two insulated wire jumpers 72 attached to the terminals of LED power terminal 67 on controller the PCB of carrier plate 342 so that electric power can be transmitted to the LED light sources for the lighting device 10. The jumpers 72 are passed through one of the primary vent holes 84 of base 81*a*. The individual LEDs 91 on the right angle prism of LED module 390 are electrically interconnected in series or in parallel serial pairs by small wires which are not shown in FIGS. 15 and 16 for reasons of clarity. The wiring pattern depends on the operating voltages needed for the particular type and color of high flux LED being used.

Figure 19:
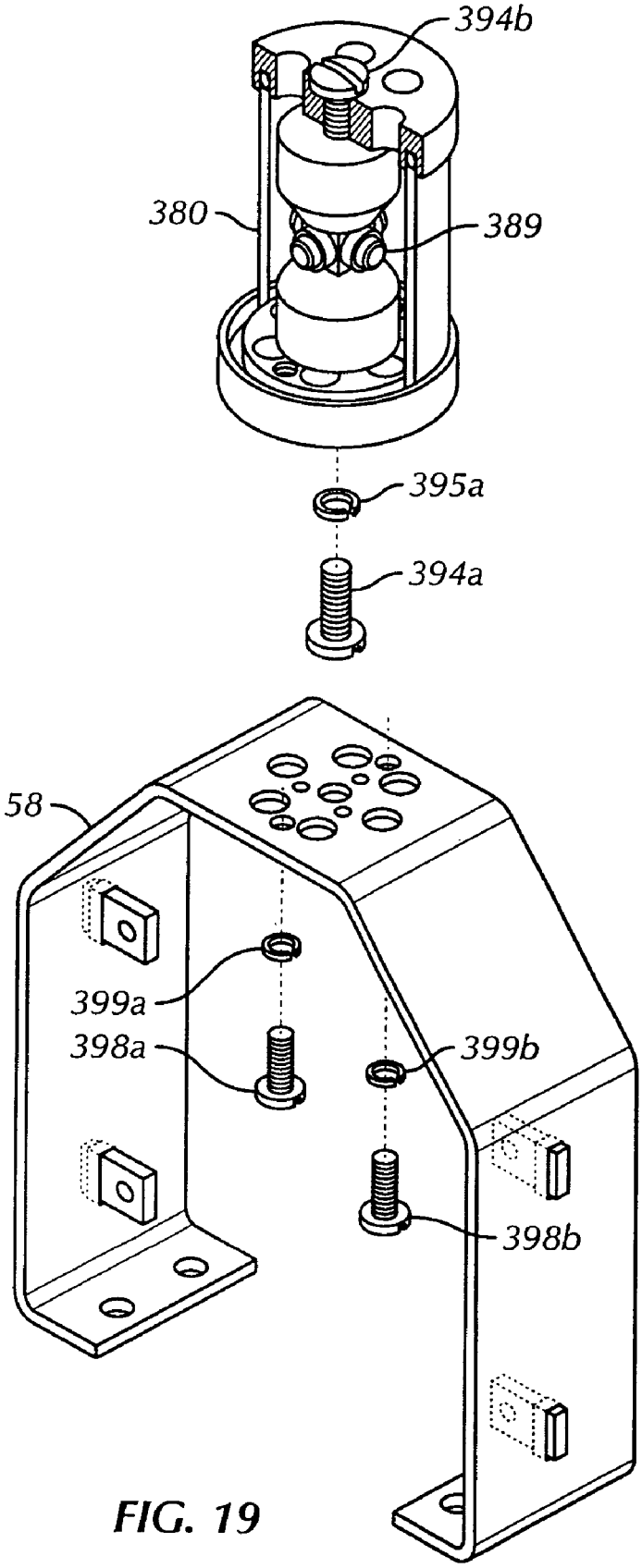
FIG. 19 is a partially exploded oblique view, partially in section, showing details the mounting of the fourth embodiment of the source LED module with the PCB bracket of the first embodiment of the control unit shown in FIG. 4.

Alternatively, the LED assembly 380 may be mounted on the PCB bracket 58 as shown in FIG. 19. LED source assembly 380 is mounted to the spaced apart mounting holes of the horizontal central upper section of bracket 58 by means of pairs of screws 398*a,b* and lock washers 399*a,b* which threadedly connect to the threaded holes 86 on the bottom end of base 81*a*.

When LED source assembly 380 is mounted on the PCB bracket 58, a firm contact between the bases 81*a,b* and the LED assembly 389 is maintained to ensure good thermal conductivity between the module 390 and the bases 81*a,b*. The firm contact is maintained on the top side by clamping the entire LED source assembly 380 by means of screw 394*b* and lock washer 395*b* inserted through the central bore of base 81*b* and threadedly connected to the threaded holes on the upper ends of LED module block 390. The firm contact is maintained on the bottom side by means of screw 394*a* and lock washer 395*a* inserted through the central bore of base 81*a* and threadedly connected to the central threaded hole on the lower end of LED module block 390.

Figure 22:
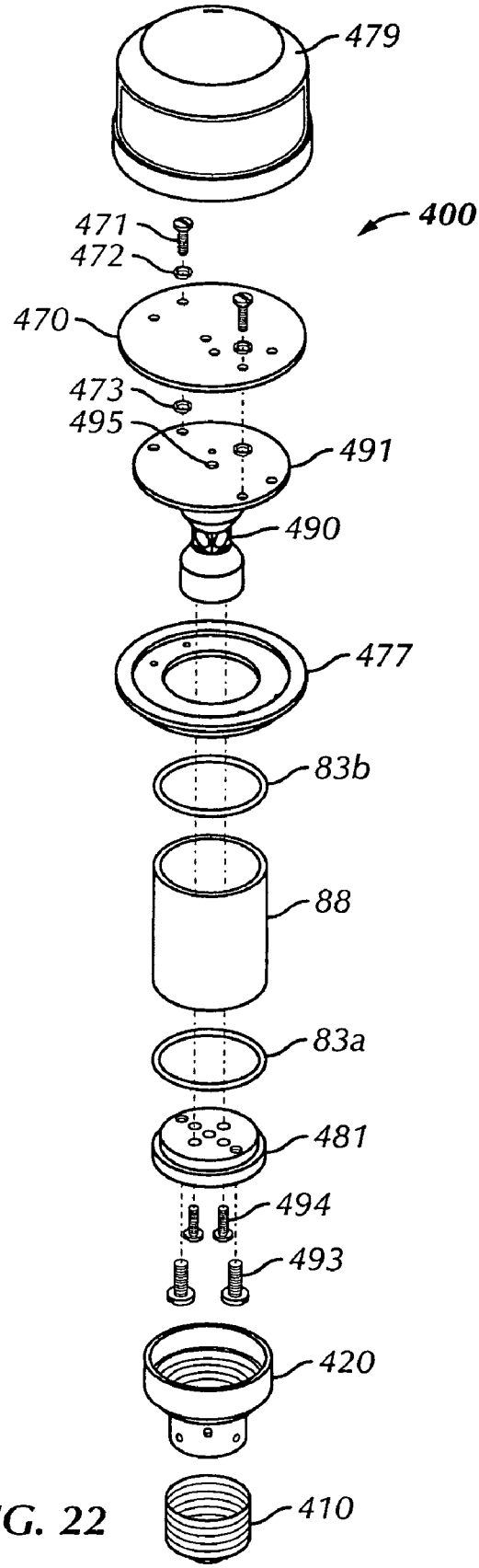
FIG. 22 is an oblique exploded view of another embodiment of the lighting device of the present invention.
Figure 23:
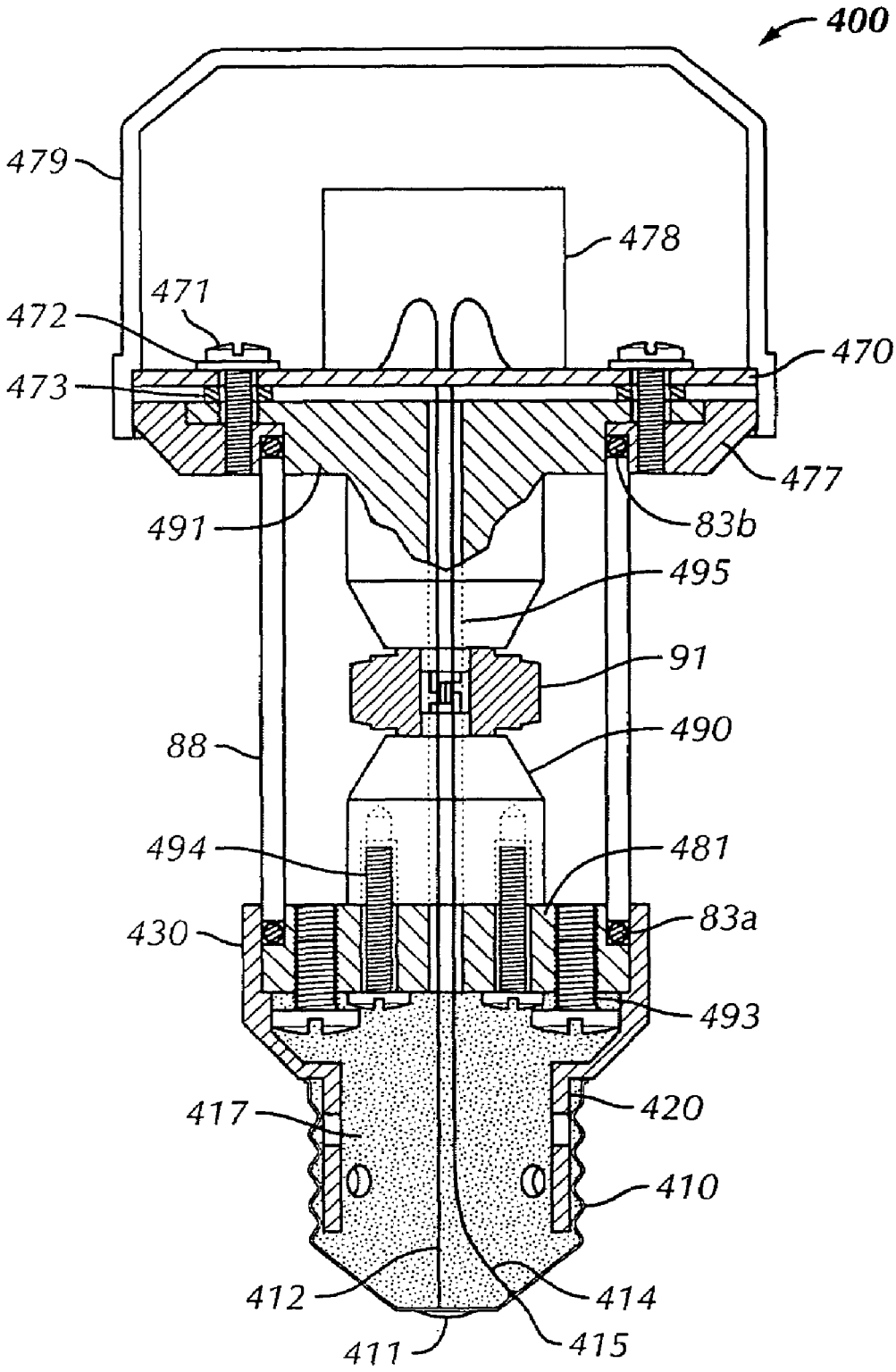
FIG. 23 is a vertical cross-sectional view of the lighting device of the present invention of FIG. 22.

Referring to FIGS. 22 and 23, a second embodiment of the lighting device 400 is shown. This embodiment, which has its own either open- or closed-frame electrical power supply unit 470 for converting the input electric current, is configured to be mounted in a standard screw-in type socket base (not shown). The screw plug shell 410 is a substantially constant thickness thin walled modified cylindrical shell. Screw plug shell 410 has, from its upper end, a short straight right circular cylindrical segment, a downwardly extending roll-formed righthand thread compatible with one of the standard sizes of screw-in sockets, and a frustro-conical end which is reduced in diameter on its lower end. The major diameter of the thread is the same as the outer diameter of the upper segment, while the minor diameter is the same as the largest diameter of the frustro-conical lower end. The top end of screw plug shell 410 is open.

First input power wire 412 is insulated except on its lower and upper ends. Solder contact button 411 is a highly ovaled ovate spheroid which has a relatively short axial length compared to its diameter. Contact button 411 is positioned coaxially at the lower end of first wire 412. First wire 412 is positioned coaxially with screw plug shell 410 such that the contact button 411 protrudes slightly beyond the lower end of the screw plug shell 410. A second input power wire 414 is insulated except on its lower and upper ends and is soldered at its lower end at 415 to the interior lower end of the screw plug shell 410. Although the lower portion of second power wire 414 is bent slightly, most of the power wire 414 runs adjacent and parallel to the first power wire 412.

Potting cup 420 is an annular cylinder having thin wall of a constant thickness over most of its length and constructed of a nonconductive compound, such as a high molecular weight high density filled polyethylene or a phenolic resin. Starting from the upper end, potting cup 420 has a short right circular cylindrical annulur section with an upwardly facing first internal transverse shoulder at approximately midlength, joined by a frustro-conical transition to a reduced diameter, an inwardly projecting second transverse shoulder section, and a straight cylindrical section. The length of the lower cylindrical section is equal to approximately half of the overall length of the potting cup 420. The lower cylindrical section is penetrated by multiple radially oriented circular holes. Potting cup 420 is inserted into the larger, upper end of the screw plug shell 410 so that its downwardly facing second transverse shoulder abuts the upper transverse end of the screw plug shell.

Lower end plate 481 is a black anodized aluminum short right circular cylindrical disk with a larger diameter lower end which has a close slip fit to the upper inner diameter of the potting cup 420, a transverse upwardly facing shoulder, and a smaller diameter upper end which is a close slip fit inside the bore of the diffuser 88. The outer diameter of lower end plate 481 is the same as that of diffuser 88. The lower transverse face of the lower end plate 481 rests against the upwardly facing first transverse shoulder of the potting cup 420. The diameter of the upper end is reduced so that it and the upward facing transverse shoulder can serve as two sides of a face-seal O-ring groove for the mounting of O-ring 83*a*. The inner diameter of the upper end of potting cup 420 then serves as the third side of the face-seal O-ring groove. The disk has an axial through hole for passage of wires 412 and 414 and a first pattern of four equispaced off-axis through holes located on a circle with a diameter equal to about one third of the lower end plate 481 outer diameter. Additionally, two other drilled and tapped through holes in a second pattern are diametrically opposed and located at radii equal to about two thirds of the outer diameter of lower end plate 481. Lower end plate 481 is mounted with its axis vertical. Multiple panhead screws 494 are mounted in the first pattern of holes of lower end plate 481 with their threaded ends protruding upwardly above the upper transverse face of the plate to engage the LED module block 490, as described in a subsequent paragraph. The set screws 493, as shown in FIG. 23, are mounted in the drilled and tapped holes of the second hole pattern and extend downwardly below the lower transverse surface of the lower end plate 481.

The LED module block 490 is similar in many respects to the LED module block 390, described previously. LED module block 490 is made from a single piece of black anodized aluminum alloy and has at its upper distal end an integral, concentric right circular cylindrical heat sink disk 491 which has a thickness substantially less than the diameter of the disk 491. The lower side of the disk has a downwardly facing horizontal transverse shoulder that extends to a reduced diameter cylinder which in turn is a slip fit into the bore of the diffuser 88. The LED module block 490 has a coaxial through hole 495 for accommodating wires 412 and 414 and the wiring (not shown) for supplying power to the LEDs 91. The lower transverse end of LED module 490 is provided with a concentric circular pattern of drilled and tapped holes consistent with the pattern in the lower end plate 481 so that screws 194 can be used to attach the lower end plate onto the bottom of the LED module, as shown in FIG. 23. The upper heat sink disk 491 is also provided with multiple off-axis drilled holes for the mounting of the power supply 478 and its cover 479.

The main portion of the LED module block 490 is a right circular cylindrical shaft having symmetrical frustro-conical transitions to its reduced cross-section central section. The central section of LED module block 490 is composed of a cubic or nearly cubic right angle prism with a square horizontal cross-section. Associated with each face of the right angle prism are a pair of horizontal arcuate flats, one at the prism bottom and one at the prism top, which are the transitions between the frustro-conical transitions and the right angle prism. One or more of the four faces of the right angle prism provides a mounting surface for a LED 91 in the center of its vertical face.

The outwardly projecting light source LED 91 which is mounted on one of the central prismatic faces of the LED module block 490 is attached to its face of the module 490 with an adhesive such as Loctite Product Output 315, which is a high temperature thermally conductive one-part acrylic adhesive or a two-part epoxy compounded with a filler such as aluminum nitride or silver to enhance the thermal conductivity of the adhesive bond.

The LED 91 is connected as before by two insulated wire jumpers (not shown) attached to the power supply 478 so that electric power can be transmitted to the LED light source for the lighting device 400. The jumpers would be passed through either an off-axis vertical hole in the heat sink 491 or through a radial hole intersecting the axial through hole 495 in the LED module block 490.

Clamp ring 477 is a horizontal nonconductive plastic member which serves to mount the diffuser 88 and the power supply module 478 when the ring is clamped to the heat sink 491 of the LED module block 490. Clamp ring 477 is an annular flat ring with transverse upper and lower surfaces and a right circular cylindrical outer face with a large chamfer on its lower external corner. Clamp ring 477 has a concentric circular through bore with a first downwardly facing counterbore on its lower side and a larger second counterbore on its upper side. The first counterbore is a close slip fit to the exterior of diffuser 88, and the second counterbore is a slip fit to the outer diameter of the heat sink disk 491. Both counterbores are adjoined to the central bore by transverse shoulders. Drilled and tapped vertical off-axis holes are provided on the same pattern as those of the off-axis holes in the heat sink disk 491 for engagement by pan head screws 471 and washers 472, so that the clamping of the clamp ring 477 to the heat sink disk can be accomplished.

The power supply circuit board 470 is made of conventional nonconductive printed circuit board material with structural and electrical attachments provided for the schematically shown power supply 478. The wires 412 and 414 are attached to the power supply 478, as are the leads conveying power to the LEDs 91. Power supply 478 operates without use of a transformer and rectifies the input power if it is AC and adjusts the voltage level of the output to conform to the needs of the LED 91.

Snap-on protective cover 479 is a thin walled plastic structure with a vertical right circular cylindrical side joined to a transverse upper diaphragm by a large chamfer. The lower opening of the cover 479 is slightly enlarged to provide sufficient interference fit to either or both of the outer diameters of power supply circuit board 470 and the clamp ring 477 that the cover can be retained thereon.

The lighting device 400, as shown in FIG. 22, is assembled in two sequential steps. For the first step, before assembly, clamp ring 477 is concentrically positioned against the lower side of heat sink 491 of LED module block 490. A first O-ring ring 83*b* is placed in the face seal O-ring groove formed between the heat sink plate 491 of LED module block 490 and the clamp ring 477. Diffuser 88 is concentrically positioned with its upper end abutting the first O-ring 83*b* in the upper face seal groove. A second O-ring 83*a* is placed concentrically around the reduced diameter upper cylindrical face of the lower end plate 481 and then screws 494 are used to connect the lower end plate to the bottom transverse end of LED module body 490 using the tapped holes thereon.

The upper end of potting cup 420 is engaged around the second O-ring 83*a*, the diffuser 88, and the lower end plate 481 so that the upper transverse interior shoulder of potting cup 420 abuts the lower end of the lower end plate. At this point, both O-rings 83*a,b* are sealingly engaged so that the volume enclosed by diffuser 88 is isolated. The length of diffuser 88 is selected such that the O-rings 83*a,b* are compressed sufficiently to provide sealing but at the same time are not over compressed whenever the LED source assembly 490 is clamped together with the lower end plate 481 by the screws 494. The first input power wire 412 and the second input power wire 414 are then inserted through the axial holes in lower end plate 481 and the LED module block 490, respectively, as the screw plug shell 410 is concentrically abutted with the intermediate downwardly facing transverse shoulder of potting cup 420.

For the second assembly step, the inverted plug base assembly 430 consisting of the of the screw plug shell 410, the potting cup 420, the lower end plate 481, wires 412 and 414, and the screws 493 and 494 are potted together with insulative ceramic or plastic potting compound 417, as shown in FIG. 23. Potting compound 417 completely fills the interior of shell 410 to the bottom end of the screw plug shell and interconnects the elements of the plug base assembly. Specifically, potting compound 417 firmly engages the interior threads of the screw plug shell 410, the radial holes in the potting cup 420, the wires 412 and 414, and the downwardly protruding threaded ends of the Allen head set screws 493, so that the assembly 430 is unitized. The contact button 411 protrudes outwardly beyond the end of the screw plug shell 410.

The final assembly steps involve attaching the LED power leads (not shown) from the LED 91 to the circuit board 470, along with the upper ends of the input power wires 412 and 414. Panhead screws 471 are then inserted through the provided holes in the circuit board 470, nonconductive plastic tubular standoffs 473, the off-axis holes in the heat sink disk 491, and then threadedly engaged in the tapped holes provided in the clamp ring 477. The standoffs 473 help isolate the circuit board 470 from the head of the heat sink disk 491. Snap-on cover 479 can then be axially engaged by forcing it onto the outer peripheries of the circuit board 470 and the clamp ring 477 to complete the assembly of the LED source module 400.

Operation of the Invention

The present invention is a compact, high intensity light source, based upon high flux light emitting diodes (LEDs), which is configured to serve as a direct replacement for electrical single bulb incandescent light sources in existing lighting devices for marine, highway and airway traffic. The lighting device 10 of the present invention is particularly suited for marine and airway navigation aids. The lighting device 400 is suitable for a wider spectrum of devices such as standard traffic lights, roadway hazard lights and airport runway lights.

The lighting device of the present invention avoids the need to replace existing lighting fixtures, especially the expensive fresnel lens used to focus the emitted light beam when converting from an incandescent to a LED light source. Prior LED light sources used large quantities of LEDs to get sufficient light output and were physically too large to fit into existing fresnel lenses. Furthermore, prior LED light sources were unsuitable for placing within existing fresnel lenses or using as a retrofit for existing lighting fixtures due to the substantial deviation of location from the focal point of those fresnel lenses.

Conventional single bulb light source filaments for typical navigation aids are very compact and hence closely resemble point sources. Consequentially, the light beam emitted when using the prior LED light sources with the single bulb fresnel lenses was sufficiently unfocused that the required light intensities could not be obtained. The physical configurations of the LED patterns in the different embodiments of the present invention are sufficiently compact that existing fresnel lenses designed for single incandescent bulb sources can be used successfully. In addition, the compactness of the described LED light assemblies allow them to be placed at appropriate positions within the lens 37 of the lantern structure 30. The sizes and attachment points of the mounting U-bracket 49 and base plate 342 and controller assemblies 40 are also compatible with the mounting base 20 of the large number of existing units based upon commercially available lighting devices such as the marine beacon designs of Automatic Power, Inc., Houston, Tex.

Although the high flux LEDs provide sufficient candlepower, they introduce the necessity to convey heat away from the LEDs in order to avoid reducing the useful lifespan of the LEDs. This requirement is due to a rapid deterioration in LED useful life when exposed to temperatures elevated above a critical threshold. Since the LED assemblies of this invention are almost fully enclosed or fully enclosed and sealed, use of the thermally conductive support mountings for the LEDs as heat sinks to distribute the heat away from the LEDs increases the life expectancy of the LEDs and further enhances the practicality of the lighting devices of the present invention. This is particularly important for the high flux LEDs. The heat conducted away from the LEDs by the heat sink behavior of the support mountings of the LED assemblies is conveyed to the bases 81*a,b* where it is radiated away. High heat loads were never a significant problem for prior LED light sources, because the individual LEDs in those cases were not large heat emitters and were diffusely mounted so they could freely reject heat.

Another means of reducing heat output during the operation of the multi-tiered LED source assemblies 80 and 180 is to drive the center LED tier at a higher power level than used to drive the two outer LED tiers. Preferably, the center tier that is positioned at the focal point of the fresnel lens is run at 80%–100% full power, while the top and bottom tiers of LED source assemblies 80 and 180 are driven at 30%–60% of full power. The differential powering of the LED tiers provide a lighting source that operates more efficiently, produces less heat, and provides increased vertical divergence. The increased vertical divergence observed in these marine lanterns is great for such as marine or airway navigational lights, increasing their visibility to six or seven miles.

Furthermore, the high flux LEDs offer the advantage of minimizing the number of LEDs required and thereby permit construction of a sufficiently compact light source to approximate a point source. However, the rather narrowly focused light output of the commercially available LEDs causes the light emitted by the LED assemblies of the present invention to be nonuniformly distributed in spherical coordinates. This poor light distribution of the unsupplemented LED assemblies 89, 189, 289, and 389 precludes their usefulness in certain navigation aid lighting devices. This deficiency is substantially eliminated by addition of the tubular glass diffuser 88, having a dentated surface with a roughened microfinish, closely spaced in proximity around the LED source assemblies. The resulting refractive redistribution by the diffuser of the impinging light from the LEDs 91, as measured in spherical coordinates for the range of emission angles possible with the assembled structure of the nontransparent components of each of the LED source assemblies 80, 180, 280, and 380, results in a more uniformly reemitted light pattern. The approximation to uniformity of the reemitted light from the diffuser 88 is sufficient to permit using the embodiments of the present invention as a substitute for navigation aid incandescent bulb light sources.

The general operation of the lighting device 10 is mounted on a supporting structure, such as that shown in FIG. 1. The mounting base 20 and lantern assembly 30 are generally common to the various embodiments of lighting device 10, since the controller assemblies 40 or 340 and LED source assemblies 80, 180, 280, and 380 are all designed to be retrofits into existing units in the field.

The mounting base 20 provides a housing for the control unit and serves as a base for stable support of the lens structure of the lantern assembly. The control unit serves to condition the power provided to operate the light source of the lighting device so that it is delivered at the proper voltage, has current limiters, and other desirable features. Since many navigation aids are required to flash in a prescribed, regular pattern, the controller assembly 40 or 340 also provides control and timing functions to cause its output power to the light source to turn on only when it is dark and to cycle on and off in order to cause flashing in the prescribed pattern. All of these functions are standard for beacons and marine lighting devices used in existing navigation aids.

The structure of the LED source assemblies 80, 180, 280, and 380 all have certain key features in common, in that all use a diffuser 88 mounted in the same manner with O-rings in grooves in the end bases 81*a,b*. The primary differences in LED mounting construction lie in the number of LEDs required and the arrangement of the structural supports for the LEDs so that construction of the assemblies is eased and the assemblies can properly reject the heat produced by the LEDs. Besides providing structural support for mounting and aligning the LEDs 91, each of the LED modules 90, 190, 290, and 390 provides a heat sink and a path for conductive heat transfer to the end bases 81*a,b* of the LED source assemblies so that the excess heat load from the LEDs can be released through radiation. Whenever the LED source assemblies are not sealed and an air circulation path is provided, the heat is also removed via convection with the circulating air within the lantern assembly 30. The heat is then released to the walls of the lantern assembly 30 and housing 20 and, in turn, to the external environment. The required size of the LED module is related to the heat generated by its set of LEDs, with higher heat fluxes requiring larger heat sinks in order to hold the LED temperature below the critical threshold at which LED life is precipitously reduced.

The construction of the LED source assemblies is sufficiently compact to permit their use with preexisting Fresnel lenses 37, since the LEDs in the array for the different types of LED assemblies are positioned closely enough to the focal point of the lenses to avoid excessive divergence of the emitted light from the lenses. If this were not the case, then even more powerful light sources requiring more LEDs than the present invention would be required, with attendant heat rejection problems. However, the main problem would be that a new, very expensive lens configuration would be required with the use of a more diffuse light source.

Figure 20:
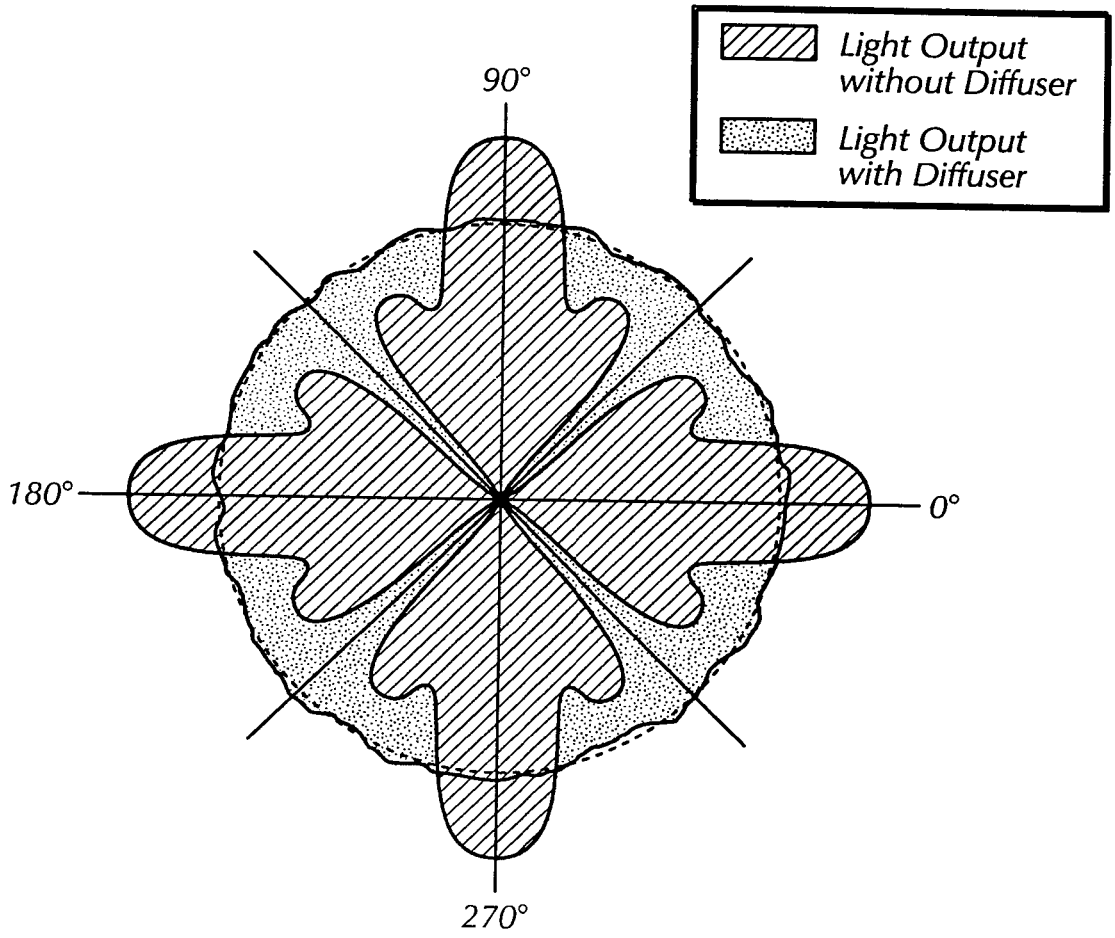
FIG. 20 is a polar coordinate diagram illustrating the circumferential variation in light output from the lantern assembly with and without use of a diffuser.

The provision of the diffuser 88 smoothes and tends to uniformize the spherical distribution of output light reradiated from the diffuser relative to the input closely focused narrow beam outputs directly from the LEDs. This critical feature permits avoiding the need to provide a very large array of LEDs so that their overlapping patterns of radiated light will closely approximate a uniform light source. Without provision of the diffuser of the present invention, it would be impractical to use a light source having as few as 4 to 12 equispaced LEDs, since the distribution in the horizontal plane of light emitted from the lens with such an array would have an insufficient intensity in the arc segments between the LED projection centerlines, as shown in FIG. 20.

The lighting device 400 with its threaded base offers a convenient unitized light source which can be installed by simply screwing it into a standard threaded socket. Because the power supply 478 is not based upon use of a transformer, the power supply can operate on any AC input voltage over a broad range of, say, between 85 VAC and 265 VAC. This permits the same LED source module to work in both Europe and the United States, thereby simplifying stocking of inventory.

Although the lighting device 400 can be used in a lighting fixture with a fresnel lens, it is anticipated that it will more commonly be used in applications without the fresnel lens. However, the use of the diffuser 88 and the resultant uniform distribution of light make the lighting device 400 particularly suitable for a wide variety of applications, such as aviation runway lights, marker lights for marine bridges and piers, hazard lights, marker lights for towers and buildings, and traffic lights. The LED assembly 389 uses a similar but integral heat sink disk for conducting heat away from its LED 91. Its relatively low construction cost and long life can permit the sealed LED source module 400 to be employed economically on a throw-away basis.

Although the present invention and its advantages have been described in detail, it should be understood that various changes, substitutions and alterations can be made herein without departing from the spirit and scope of the invention as defined by the appended claims.

What is claimed is:

1. A lighting device comprising:

(a) a plurality of LEDs disposed in a radial array about a vertical axis;

(b) a central member having each LED mounted on a vertical surface thereof, the central member made of a thermally conductive material to conduct heat away from the LEDs, wherein the central member comprises three substantially identical right angle prisms with substantially identical square horizontal cross-sections with four vertical surfaces; and (c) a hollow member having a dentated surface, wherein the dentated surface surrounds the LEDs to diffuse the light emitted from the LEDs.

2. The lighting device of claim 1, further comprising a curved optical lens disposed about the vertical axis surrounding the hollow member, wherein the lens converges beams of light emanating from the hollow member in all horizontal directions.

3. The lighting device of claim 1 having twelve LEDs.

4. The lighting device of claim 1, wherein the LEDs have a driving current of about 1–5 Watts.

5. The lighting device of claim 1, wherein the LEDs are enclosed in an airtight enclosure.

6. The lighting device of claim 1, wherein the central member is made of metal.

7. The lighting device of claim 1, wherein the central member is in contact with a thermally conductive element, a portion of said thermally conductive element in contact with the air from outside of the lighting device.

8. The lighting device of claim 1, wherein the LEDs are secured to the central member using a thermally conductive adhesive.

9. The lighting device of claim 1, wherein the hollow member is made of an optically transparent, heat resistant material.

10. The lighting device of claim 1, wherein the hollow member is made of glass.

11. The lighting device of claim 1, further comprising a light socket base electrically connected to the LEDs.

12. The lighting device of claim 1 designed to fit within a fresnel lens of a navigational light.

13. A lighting device comprising:

(a) a plurality of LEDs disposed in a radial array about a vertical axis;

(b) a central member having each LED mounted on a vertical surface thereof, the central member made of a thermally conductive material to conduct heat away from the LEDs, wherein the central member has a first and second circular disk mounted on opposed ends of the central member transverse to the vertical axis of the central member; and (c) a hollow member having a dentated surface with a random pattern of microfaceted angles on the surface, wherein the microfaceted angles diffuse the light emitted from the LEDs and wherein a first end of the hollow member is mounted in a first groove in the first circular disk and a second opposed end of the hollow member is mounted in a second groove in the second circular disk.

14. The lighting device of claim 13, having four LEDs in the radial array spaced 90 degrees apart in a common horizontal plane.

15. The lighting device of claim 13, wherein the dentated surface of the hollow member is sandblasted.

16. The lighting device of claim 13, wherein the central member has a centralized right angle prism with a square horizontal cross-section.

17. A lighting device comprising:

(a) a plurality of LEDs disposed in a radial array about a vertical axis;

(b) a central member having each LED mounted on a vertical surface thereof, wherein the central member comprises three substantially identical right angle prisms with substantially identical square horizontal cross-sections with four vertical surfaces and wherein the central member is made of a thermally conductive material to conduct heat away from the LEDs;

(c) a hollow member having a dentated surface with a random pattern of microfaceted angles on the surface, wherein the microfaceted angles diffuse the light emitted from the LEDs; and (d) a curved optical lens disposed about the vertical axis surrounding the hollow member, wherein the lens converges beams of light emanating from the hollow member in all horizontal directions;

whereby light emanating from the LEDs passes through the dentated surface of the hollow member and the optical lens to provide a substantially uniform horizontal plane of light.

18. The lighting device of claim 17, wherein the lens includes a focal point in a horizontal plane that intersects the radial array of LEDs.

19. The lighting device of claim 17, wherein the dentated surface of the hollow member is uniformly frosted.

20. The lighting device of claim 17, wherein the hollow member is a right circular tube.

21. The lighting device of claim 17, wherein each vertical surface of the three substantially identical right angle prisms have one LED mounted thereon.

22. The lighting device of claim 21, wherein one LED is radially mounted every 30 degrees about the vertical axis.

23. A lighting device comprising:

(a) a plurality of LEDs disposed in a radial array about a vertical axis;

(b) a central member having each LED mounted on a vertical surface thereof, wherein the central member has a first and second circular disk mounted on opposed ends of the central member transverse to the vertical axis of the central member and wherein the central member is made of a thermally conductive material to conduct heat away from the LEDs;

(c) a hollow member having a dentated surface with a random pattern of microfaceted angles on the surface, wherein the microfaceted angles diffuse the light emitted from the LEDs and wherein a first end of the hollow member is mounted in a first groove in the first circular disk and a second opposed end of the hollow member is mounted in a second groove in the second circular disk; and (d) a curved optical lens disposed about the vertical axis surrounding the hollow member, wherein the lens converges beams of light emanating from the hollow member in all horizontal directions;

whereby light emanating from the LEDs passes through the dentated surface of the hollow member and the optical lens to provide a substantially uniform horizontal plane of light.

* * * * *